US007824276B2

(12) United States Patent
Simpson

(10) Patent No.: US 7,824,276 B2
(45) **Date of Patent: *Nov. 2, 2010**

(54) GOLF PRACTICE APPARATUS AND METHOD

(76) Inventor: Timothy Allen Simpson, 1574 Sugar Maple Way, West Bloomfield, MI (US) 48324

( * ) Notice: Subject to any disclaimer, the term of this patent is extended or adjusted under 35 U.S.C. 154(b) by 1020 days.

This patent is subject to a terminal disclaimer.

(21) Appl. No.: 11/500,617

(22) Filed: Aug. 7, 2006

(65) Prior Publication Data

US 2007/0037631 A1 Feb. 15, 2007

Related U.S. Application Data

(63) Continuation-in-part of application No. 11/047,950, filed on Jan. 31, 2005, now Pat. No. 7,121,953, which is a continuation-in-part of application No. 10/356,810, filed on Feb. 3, 2003, now Pat. No. 6,849,001.

(60) Provisional application No. 60/754,454, filed on Dec. 28, 2005.

(51) Int. Cl.
*A63B 69/36* (2006.01)

(52) U.S. Cl. ..... 473/226; 473/231; 473/235; 473/236

(58) Field of Classification Search ..... 473/219–265, 473/278, 279; 273/389–393
See application file for complete search history.

(56) References Cited

U.S. PATENT DOCUMENTS

| | | | | |
|---|---|---|---|---|
| 1,025,944 | A | | 5/1912 | Elliott |
| 1,262,532 | A | | 4/1918 | McElroy |
| 1,464,029 | A | | 8/1923 | Coughtrie |
| 1,600,466 | A | | 9/1926 | Goldsworthy |
| 2,264,802 | A | * | 12/1941 | Kohl ..... 473/280 |
| 2,482,057 | A | * | 9/1949 | Fincke ..... 273/393 |
| 3,032,345 | A | | 5/1962 | Lemelson |
| 3,185,476 | A | | 5/1965 | Fechner |
| 3,194,564 | A | | 7/1965 | Swan |
| 3,325,168 | A | | 6/1967 | Fyanes |
| 3,384,376 | A | | 5/1968 | Greenlee |
| 3,401,941 | A | | 9/1968 | Hesidence |
| 3,406,571 | A | | 10/1968 | Hackey |
| 3,554,543 | A | | 1/1971 | Dilaura |
| 3,721,447 | A | | 3/1973 | Louderback |
| 3,738,660 | A | | 6/1973 | Branz et al. |
| 3,940,145 | A | | 2/1976 | Gentiluomo |
| 4,054,288 | A | | 10/1977 | Perrine, Sr. |
| 4,433,843 | A | | 2/1984 | Bricco |
| 4,470,603 | A | | 9/1984 | Myers |
| 4,630,829 | A | | 12/1986 | White |
| 4,718,677 | A | | 1/1988 | Barnes |
| 4,844,469 | A | | 7/1989 | Yasuda et al. |
| 4,875,685 | A | | 10/1989 | Ballinger |
| 4,877,251 | A | | 10/1989 | Faust |
| 4,969,645 | A | | 11/1990 | Barbador |
| 5,026,064 | A | | 6/1991 | Novosel |
| 5,082,284 | A | | 1/1992 | Reed |

(Continued)

*Primary Examiner*—Sebastiano Passaniti
(74) *Attorney, Agent, or Firm*—Ernest E. Helms; Warn Partners, P.C.

(57) ABSTRACT

A golf practicing apparatus is provided which includes a club with a latch member. A target is provided which is held by a mount. When the golf club is swung in a predetermined manner, the target is released from the mount and is connected with the golf club.

30 Claims, 29 Drawing Sheets

U.S. PATENT DOCUMENTS

| | | | | |
|---|---|---|---|---|
| 5,213,324 | A | 5/1993 | Bowers | |
| 5,255,920 | A | 10/1993 | Mangeri | |
| 5,480,141 | A | 1/1996 | Wood | |
| 5,577,964 | A | 11/1996 | Chen | |
| 5,718,642 | A | 2/1998 | Cushing | |
| 5,782,701 | A | 7/1998 | O'Bryan | |
| 5,803,836 | A | 9/1998 | Beintema | |
| 5,833,555 | A | 11/1998 | Jer-Min | |
| 6,244,973 | B1 | 6/2001 | Eichelberger | |
| 6,450,895 | B1 | 9/2002 | Galluzzo, Jr. | |
| 6,767,291 | B1 | 7/2004 | McCarthy | |
| 6,849,001 | B2 * | 2/2005 | Simpson | 473/226 |
| 7,121,953 | B2 * | 10/2006 | Simpson | 473/226 |
| 7,347,790 | B2 * | 3/2008 | Zimmerman | 473/235 |
| 7,392,987 | B1 * | 7/2008 | Lowrance | 273/343 |

* cited by examiner

GOLF PRACTICE APPARATUS AND METHOD

This application claims the benefit of U.S. Provisional Application 60/754,454 entitled Low Profile Hosel Clamp and Stationary Practice Target Clamp And Polymer practice Golf Club Head, filed Dec. 28, 2005 under U.S. Express Mail Label # EQ147491526; this application claims the benefit of and is a Continuation in Part of U.S. Non-Provisional Application entitled Practice Golf Club, Target, And Swing Platform Apparatus, filed Jan. 31, 2005 U.S. Ser. No. 11/047,950; which is Continuation In Part of 10/356,810, filed Feb. 3, 2003, now U.S. Pat. No. 6,849,001 entitled Practice Golf Club and Target Apparatus.

FIELD OF THE INVENTION

The field of the present invention is apparatuses for practicing golf and, more particularly, the present invention relates to an apparatus utilized to reinforce the fundamentals of the swing of a wood or iron golf club.

BACKGROUND OF THE INVENTION

To develop a consistent golf swing many fundamentals must be learned some of which include the following. The golf club must be swung along a correct swing plane that is an imaginary circular path that is parallel to the target line. The target line is a line from the golf ball to the flag or desired target point. The golf club must strike the ball with the leading edge of the clubface perpendicular to, or at a ninety-degree angle to the target line. Accordingly, it is desirable to provide an apparatus that reinforces the aforementioned fundamentals by which a golfer can use to practice developing a consistent golf swing. Additionally, during inclement weather or seasonal weather conditions, it is desirable to provide an apparatus with which one can practice golf swing fundamentals year round in an indoor setting.

SUMMARY OF THE INVENTION

The present invention provides an apparatus meeting the above noted desires in a manner that is an alternative to those revealed prior.

DETAILED DESCRIPTION OF THE INVENTION

Figure 4:
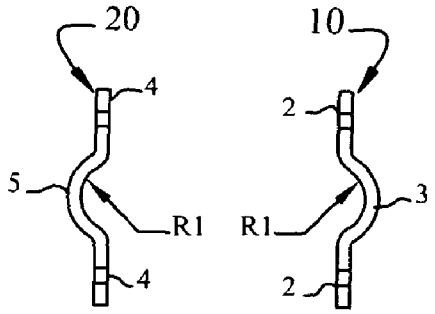
FIG. 4 is a top plan view of portions of the latch member connected on the golf club of FIG. 1.

A first hosel-clamping link or member 10 and a second hosel-clamping link or member 20 are provided in the embodiment of the present invention as shown in FIG. 4. A top edge view (FIG. 4) of the first and the second hosel-clamping member show said hosel-clamping members 10 and 20 having a first pair 2 and a second pair 4 of coplanar edges. The opposing ends of the first and second pair of edges 2 and 4 respectively connect with a first curved edge 3 and a second curved edge 5 (FIG. 4). The first and second curved edges 3 and 5 has a radius R1 with a horizontal coordinate midway between the outside extreme ends of said first and second pair of edges 2 and 4. As depicted in FIG. 4, the vertical coordinate of the radius R1 is outside of the longitudinal horizontal axis coincident with said first and second pair of edges 2 and 4, respectively.

Figure 5:
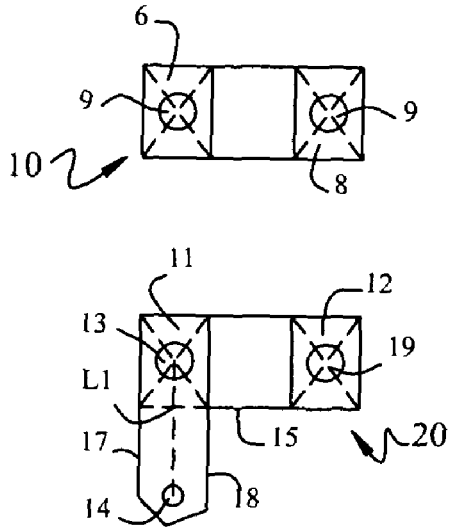
FIG. 5 is a side elevational view of the portions of the latch member shown in FIG. 4.
Figure 6:
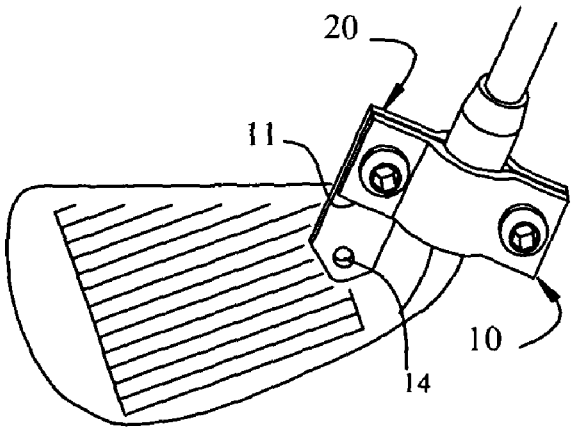
FIG. 6 is a perspective view similar to FIG. 1 with portions removed for clarity of illustration.

A top front view (FIG. 5) of the first hosel-clamping member 10 shows a left planar surface 6 and a right planar surface 8. The left and right planar surfaces 6 and 8 of said first hosel-clamping member 10 each have a bore 9. The location of the bore center on its respective planar surface is coincident with the intersection of diagonal lines connecting the corners specific to said left and right planar surfaces (FIG. 5). The bore diameters are sufficiently larger than the diameter of a ¼×20 thread pitch screw fastener thus providing sufficient clearance to receive said fastener (FIGS. 1 and 6).

A top front view (FIG. 5) of the second hosel-clamping member 20 shows a left planar surface 11 and a right planar surface 12. The left planar surface 11 has an edge that extends below a projected line L1 extending form a bottom edge 15 that intersects perpendicularly with a side edge 17 of said second hosel-clamping member. As shown in FIG. 1*d*, the left planar surface 11 has an upper bore 13 and a lower bore 14. In the embodiment of the present invention the aforementioned bores each have an axis that is perpendicular with its respective planar surface. The upper bore 13, center is coincident with the intersection of diagonal lines one of which has a point that intersects with a corner created by the intersection of extension line L1 from bottom edge 15 to an edge 18. The second diagonal line intersects a corner defined by the intersection of said extension line L1 with edge 17. The right planer surface 12 has a bore 19 with its center coincident with the intersection of diagonal lines connecting the corners of said planar surface 12 (FIG. 5). The bore diameters 13 and 19 of the second hosel-clamping member in the embodiment of the present invention are threaded with ¼×20 pitch threads. The center of the lower bore 14 is coincident with a vertical longitudinal axis that intersects with the center of the upper bore 13 (FIG. 5). The lower bore in the embodiment of the present invention is sufficiently large to provide clearance with a 10×32-thread pitch screw fastener (FIG. 1).

Figure 1:
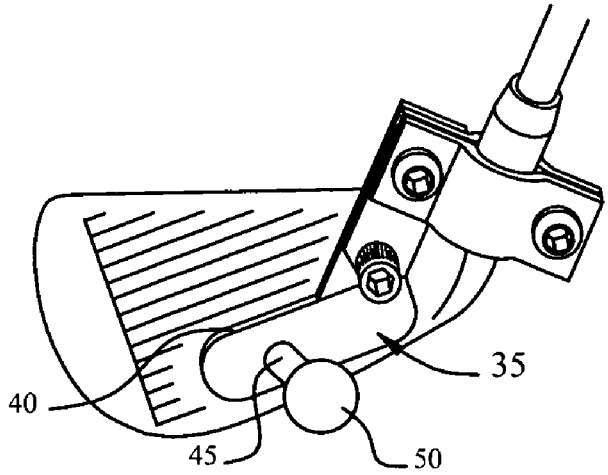
FIG. 1 is a perspective view of a golf club of a preferred embodiment of the present invention.
Figure 2:
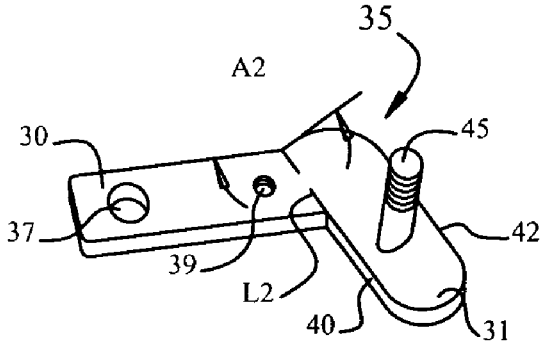
FIG. 2 is a perspective view of a portion of the latch member connected on the golf club of FIG. 1.
Figure 3:
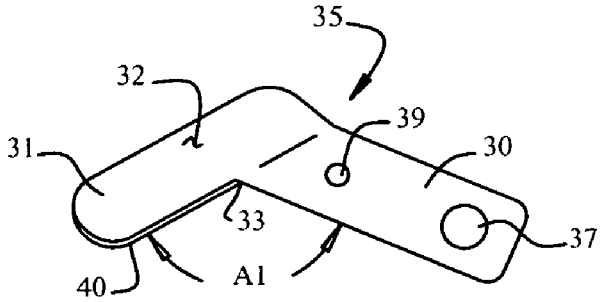
FIG. 3 is a rear perspective view of a portion of the latch member shown in FIG. 2.

Referring to FIGS. 2 and 3, a removable L-shaped planar link or extension arm 35 is provided that attaches to a surface 11 of the second hosel-clamping member 20. The extension arm 35 has a first straight section 30 and a second straight section 31. The first and second straight sections 30 and 31 meet at a corner 33 having an obtuse angle A1 that matches the lie-angle of a specific iron-golf club (FIG. 3). Accordingly, the section 31 is positioned adjacent to a face of the golf club. The first straight section 30 has an upper bore 37 that is not threaded and a lower bore 39 that have threads. The upper bore diameter in the embodiment of the present invention is sufficiently large to provide clearance with a ¼×20-thread pitch screw fastener (FIG. 1). The lower bore 39 has a smaller diameter that is threaded to receive a 10×32-thread pitch screw fastener (FIG. 1). The first and the second straight sections 30 and 31 form an angle A2 about an imaginary line L2 extending from a top edge 40 of the second straight section 31 (FIG. 2). The angle A2 matches the loft angle of an iron-golf club and aligns the first straight section 30 parallel with the hosel when a rear face 32 (FIG. 3) of the second straight section 31 is resting against the clubface (FIG. 1). The length of the first straight section 30 is sufficiently long such that upon assembly onto an iron-golf club a bottom edge 42 (FIG. 1) is sufficiently close to the bottom or heel of the golf club. A top edge 40 of the second straight section 31 is parallel with groove lines commonly found in said clubface (FIG. 1). As shown in FIG. 2, a dowel 45 projects form the second straight section 31 of the extension arm 35. The dowel 45, location is such that its centerline coincides with the centerline of the clubface when the extension arm 35 and hosel-clamping members 10 and 20 are attached to an iron-golf club (FIG. 1). The hosel-clamping members and the extension arm in the embodiment of the present invention are formed using a low carbon flat stock steel 0.100-inch thick.

Referring to FIG. 1, a spherical knob 50 latch member is provided having a blind bore (not shown) that permit the spherical knob to be pressed onto the extreme end of the dowel 45. The spherical knob 50 functions as an impact head as well as a target-hooking device given that its diameter is twice as large as that of the ¼-inch diameter dowel 45.

Figure 14:
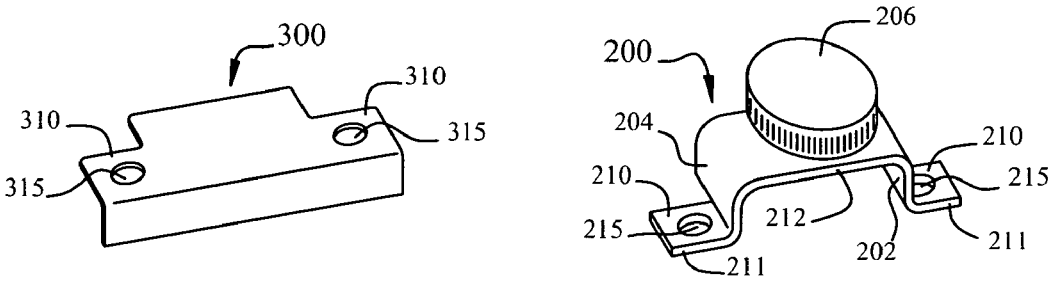
Figure 18:
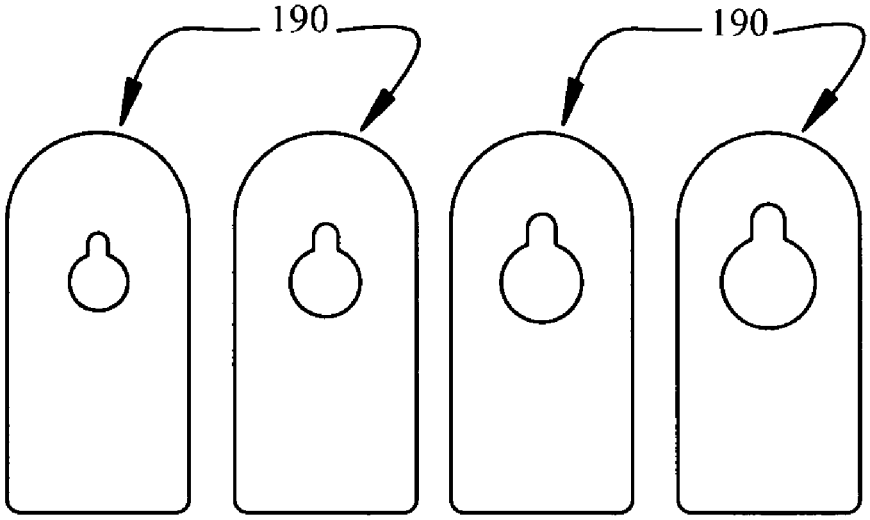
FIG. 18 is a perspective view of targets of the present invention.
Figure 18A:
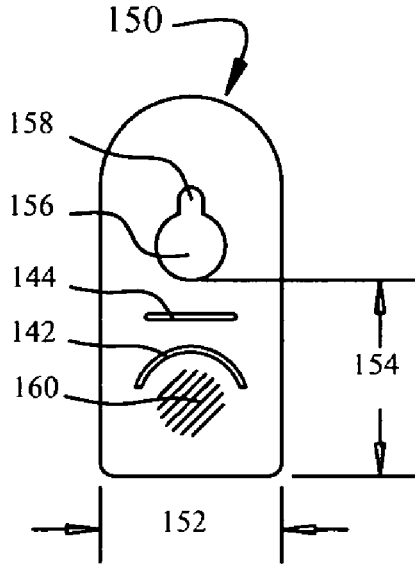
FIG. 18*a* is a front plan view of an alternate preferred embodiment target of the present invention.

Referring to FIG. 18*a*, a practice target 150 is provided. The practice target 150 is a planar member that is typically fabricated from polymeric or other suitable materials. In the preferred embodiment of the present invention, the practice target is made of an Ultra-High Molecular Weight (UHMW) polyethylene material having a thickness range of 0.085-0.135 inch. The practice target 150 has a width 152 slightly narrower than an inside dimension between a left-side face 202 and a right-side face 204, of a target-mount rigid-frame member 200 (FIG. 14). A length 154 of the practice target is determined by the location of a lower aperture 156 relative to the top surface of a turf mat 520. The lower aperture 156 is provided to receive the forward projecting portion of the dowel 45 and spherical knob 50. The lower aperture 156 opens to or connects with an upper aperture 158. The width of the upper aperture 158 equals the diameter of the dowel 45. An optional straight slit 144 is located below the lower aperture 156. The slit 144 is perpendicular with and bisected by the practice target longitudinal axis of symmetry. An optional semi-circular slit 142 is located below the straight slit 144. The semi-circular slit 142 is also bisected by the practice target longitudinal axis of symmetry. The purpose of each slit is to increase a thicker practice target's range of flexibility and thus provides more forward bending after said thicker target was struck by a practice golf club. In FIG. 18, a thinner practice target 190 is shown without slits and having different lower aperture sizes. The greater the skill level, the smaller the lower aperture size.

Figure 12:
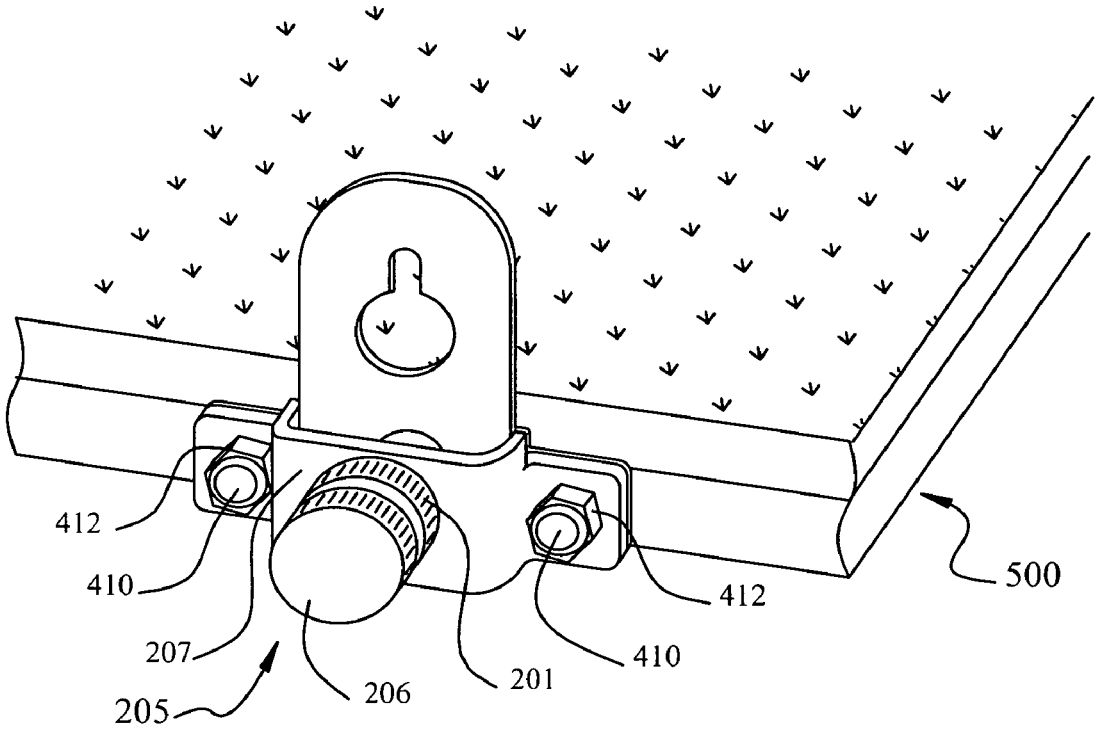
FIG. 12 is a perspective view of a mount and target of a preferred embodiment of the present invention.
Figure 13:
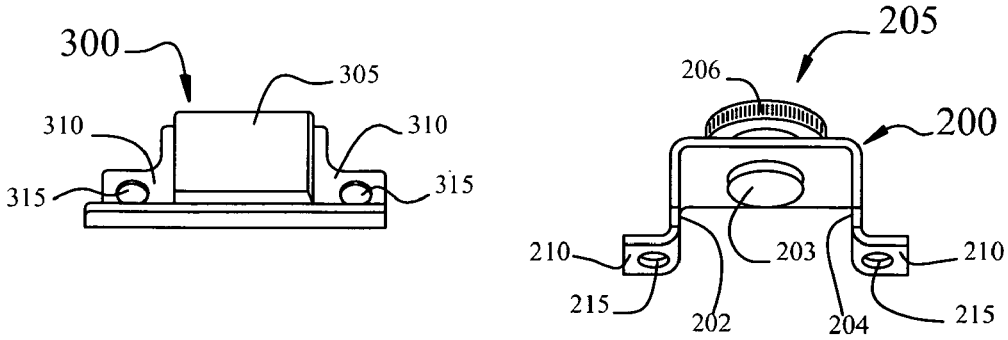
FIGS. 13 and 14 are perspective views of portions of the mount shown in FIG. 12.
Figure 20:
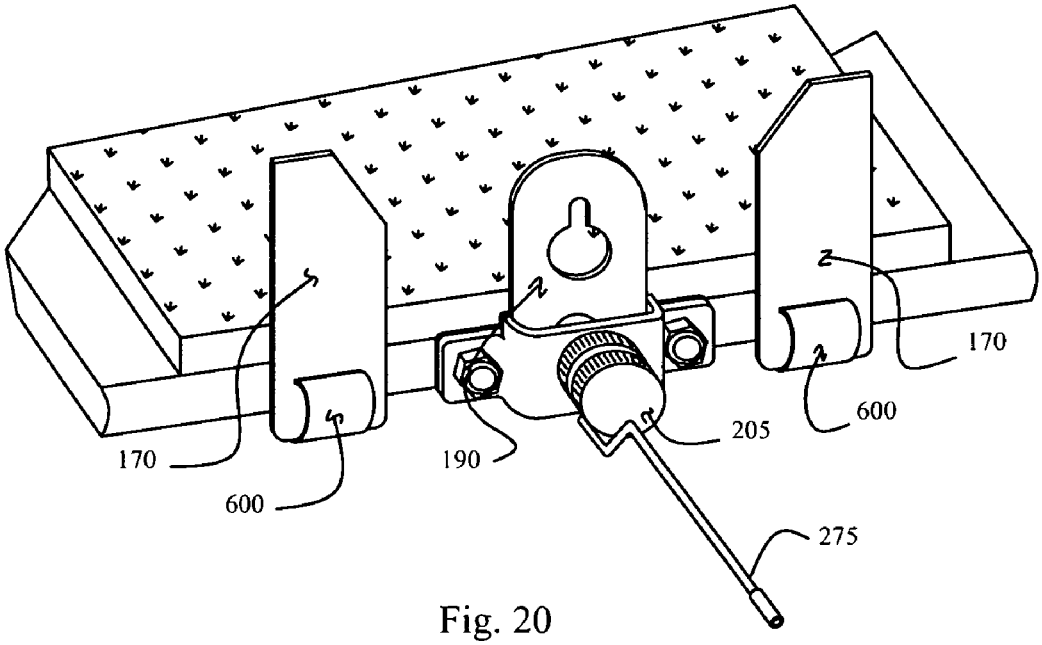
FIG. 20 is a perspective view of mount and target of the present invention juxtaposing dummy target and mounts.

Referring to FIGS. 12, 13 and 14, a target-mount rigid-frame member 200, a target-clamping screw 205 and a clamp-backing plate 300 are provided in the embodiment of the present invention. Symmetrical features of the rigid-frame member and the clamp-backing plate are given the same numerical reference. The target-mount rigid-frame member has a front face 207, which is perpendicular with its left-side face 202 and right-side face 204. A flange 210 extends perpendicularly from each side 202 and 204. A bottom edge 211 of each flange 210 is coplanar with a bottom edge 212 of the side face and front face. The front face 207 has a bore threaded with ⅝×11-pitch threads (not shown) that receives a ⅝×11-thread pitch target-clamping screw 205. The target-clamping screw 205 has a short length of threads 203 and a 1 inch diameter knob 206 having a knurled surface (FIG. 12). Referring to FIG. 20, the knurled knob 206 has a bore (not shown) that is provided to receive a swivel-torque handle 275. The two flanges 210 each have a ¼ in. diameter bore 215. The clamp-backing plate 300 also has two flanges 310 each having a ¼ inch diameter bore 315. The bore centers of the clamp-backing plate and the target-mount rigid-frame member are spaced an equal distance apart. The bore centers are aligned during assembly upon which they receive a fastener 410 to mount them securely to a front face of a plywood swing-platform base 500. The clamp-backing plate 300 has a ¼ inch polymeric rubber pad that is adhered to a front face 307 of said clamp-backing plate. A practice target 150 or 190 is inserted into the target-mount rigid-frame member between the friction pad and the leading front face of the target-clamping screw. The target-clamping screw 205 is tightened against a practice target using the swivel-torque handle 275 thus compressing the practice target against the friction pad. A thin nut 201 (FIG. 12) is provided that acts as a stop against the front face 207 of the rigid-frame member and can be adjusted to allow a preset clamp load against a practice target. The bearing area of the target-clamping screw against a practice target is a diametric area 160 (shown shaded in FIG. 18*a*).

Figure 19:
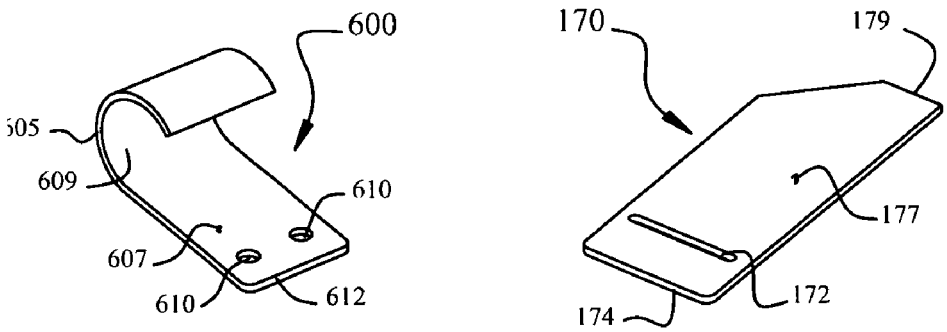
FIG. 19 is a perspective view of a dummy target and mount.

Referring to FIGS. 19 and 20, a pair of 'dummy' targets 170 are provided one of which is mounted on either side of a practice target. In the embodiment of the present invention, each of the three targets is planar and all targets can be made from the same material. The targets in the embodiment of the present invention are made from Ultra-High Molecular Weight (UHMW) polyethylene sheets. Unlike the practice target which is stationary, the 'dummy' targets are free to rotate downward facilitated by a slot 172 located a short distance from a bottom edge 174 of said 'dummy' target (FIG. 19). A curved-target mount 600 has a curved section 605 that is tangent with a straight section 607. The slot 172 within the 'dummy' target loops onto the curved section 605 thus following its contour as it pivots downward when struck by a practice club. The bottom edge 174 of the 'dummy' target contacts an inside surface 609 of the curved-target mount 600 near the tangent of the curved and straight sections of said curved-target mount when said 'dummy' target rear face 177 is resting against a front face 521 of a turf mat 520 (FIG. 20). The vertical length of the 'dummy' targets is sufficiently tall such that a top edge 179 is well above a top surface 525 of the turf mat 520. The two lines of contact between the bottom edge 174 of the 'dummy' target and the line contact said 'dummy' target makes with the turf mat 520 is spaced apart such that the 'dummy' target leans rearward. The straight section 607 of the curved-target mount 600 has a pair of bores 610 near an extreme edge 612 (FIG. 19). The bores 610 receives fasteners (not shown) to securely attach a curved-target mount 600 to the bottom surface of the swing-platform base 500.

Figure 7:
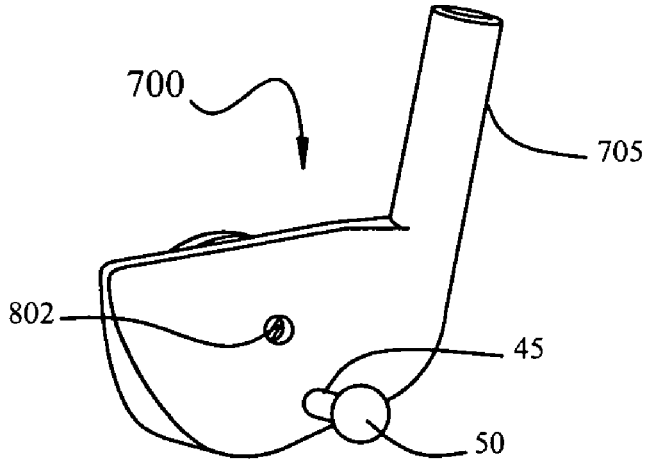
FIG. 7 is a perspective view of an alternative preferred embodiment golf club of the present invention.
Figure 8:
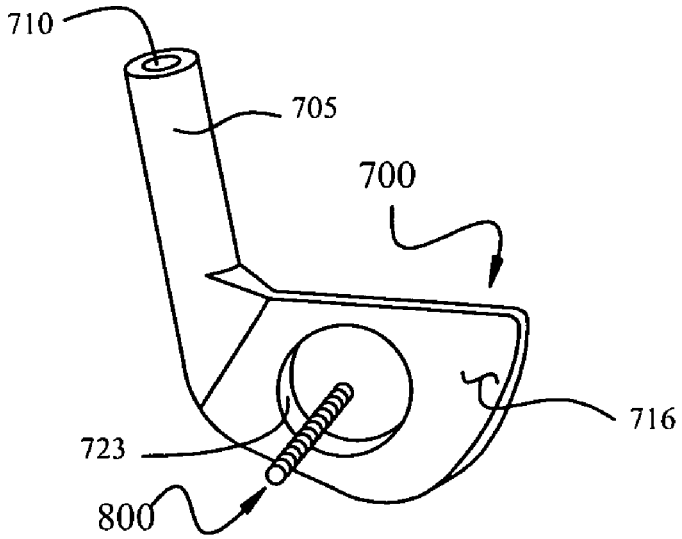
FIGS. 8 and 9 are rear perspective view of portions of the golf club shown in FIG. 7.
Figure 9:
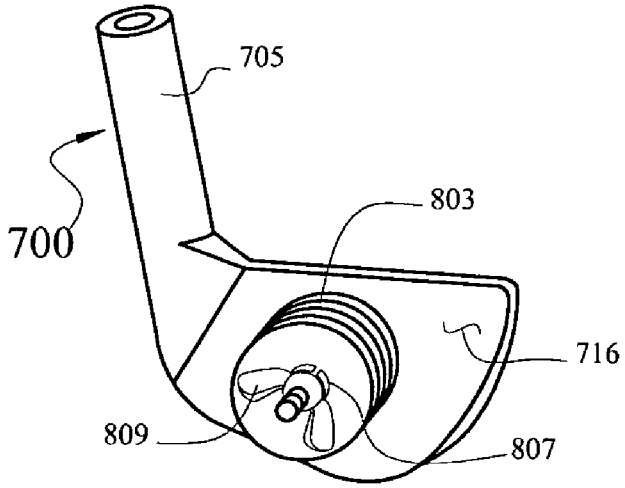
Figure 10:
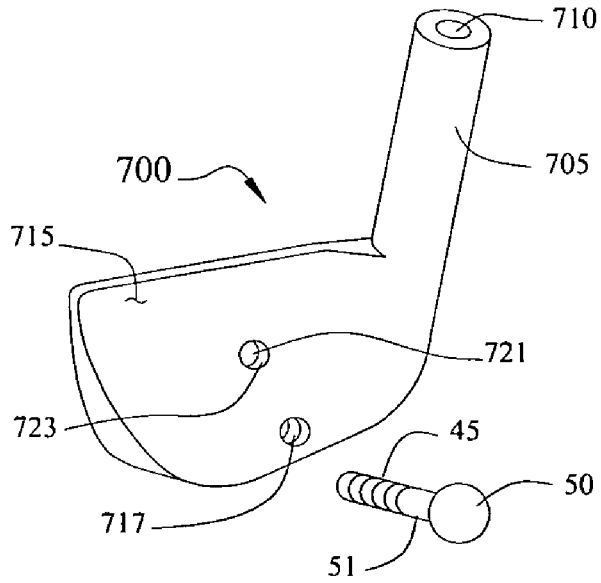
FIG. 10 is a perspective disassembled view of a portion of the golf club shown in FIG. 7.
Figure 11:
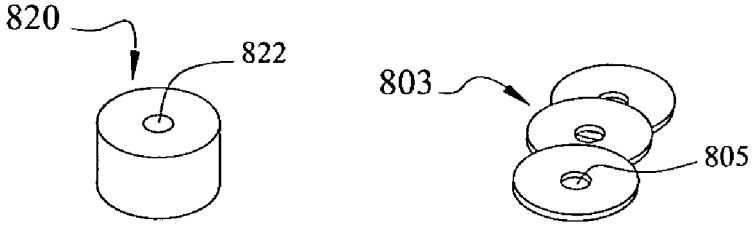
FIG. 11 is a perspective view of weights that can be utilized with the golf club shown in FIG. 7.

In an embodiment of the present inventive practice golf club a polymer club head 700 is provided as shown in FIGS. 7, 8, 9 and 10. Referring to FIG. 10, the polymer golf-club head 700 has a hosel 705 of which a longitudinal blind bore 710 is concentric. The polymer club head has a front face 715 having a lower bore 717 near a bottom edge 719 and an upper bore 721 whose center align with that of the lower bore 717. The upper bore 721 has a concentric counter bore 723. The lower and upper bores 717 and 721 respectively opens to a rear face 716 of the polymer club head. The rear face 716 and the hosel 705 are parallel. Conversely, the front face 715 and the hosel intersect at an angle matching the lie angle of a golf club. The rear face 716 of the polymer club head 700 has a large counter bore 725 concentric with upper bore 721. The lower bore 717 diameter is slightly less than one-quarter of an inch. A short dowel 45 is pressed into the lower bore 717 and extends forward from the front face 715 of the polymer club head 700. The longitudinal axis of the dowel 45 is perpendicular with the rear face 716 of the polymer club head 700. The extreme end of the dowel 45 projecting from the club head's front face receives a spherical knob 50. The spherical knob 50 has a blind bore with a diameter slightly less than that of the dowel 45 to provide an interference fit with said dowel 45. A dimension D1 (not shown) between the polymer club-head front face 715 and a lower apex 51 of the spherical knob 50 is slightly greater than the maximum thickness of a practice target. The diameter of upper bore 721 is slightly greater than the diameter of a ¼×20-thread pitch fastener 800. The diameter of the front face counter bore 723 is sufficiently large to receive a head 802 of the fastener 800 such that said head is below the surface of front face 715 (FIG. 7). The diameter of the rear face 716 counter bore 725 is sufficient large to receive a thin disk 803 having a ¼-inch diameter center bore 805 (FIG. 11). The ¼×20-thread pitch fastener 800 is sufficiently long such that a significant portion 810 extends beyond the rear face 716 of the polymer club head 700 to support multiple disks 803, which adds weight to an inherently lightweight polymer club head. An alternative embodiment of the preferred inventive weighted polymer club head includes a single thicker disk 820 having a mass equivalent to numerous thin disks 803. The single disk also has a ¼-inch diameter center bore 822 that receive the extended part 810 of fastener 800. Disks are held to the polymer club head using a lock washer 807 and a wing nut 809 (FIG. 9). A standard golf club shaft 100 can be inserted into the bore 710 within the hosel 705 and secured with epoxy (FIG. 9).

Figure 15:
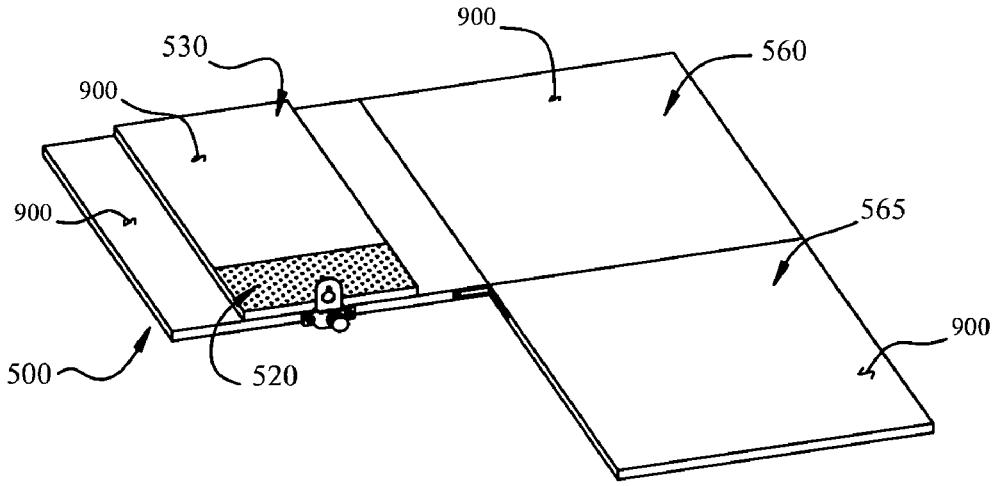
FIGS. 15-17 are perspective views of a swing platform portion of the mount shown in FIG. 12.
Figure 16:
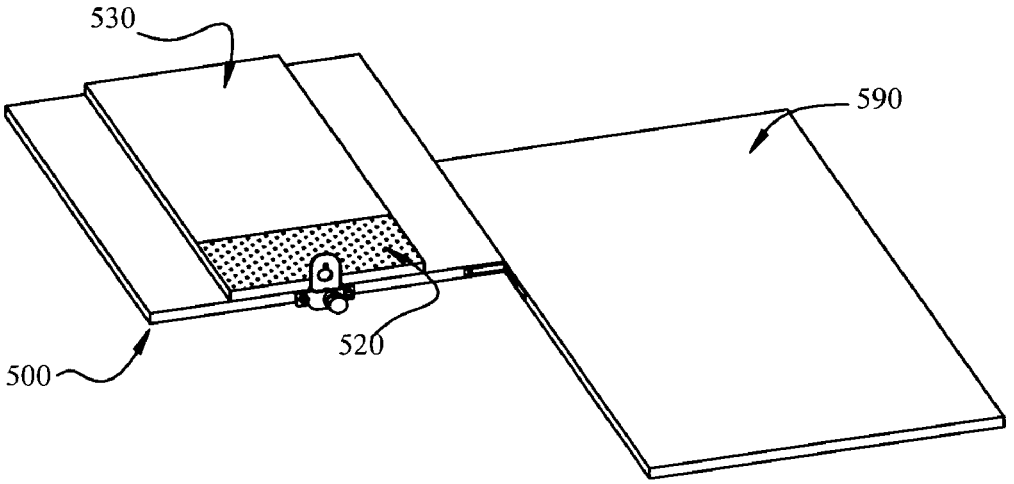
Figure 17:
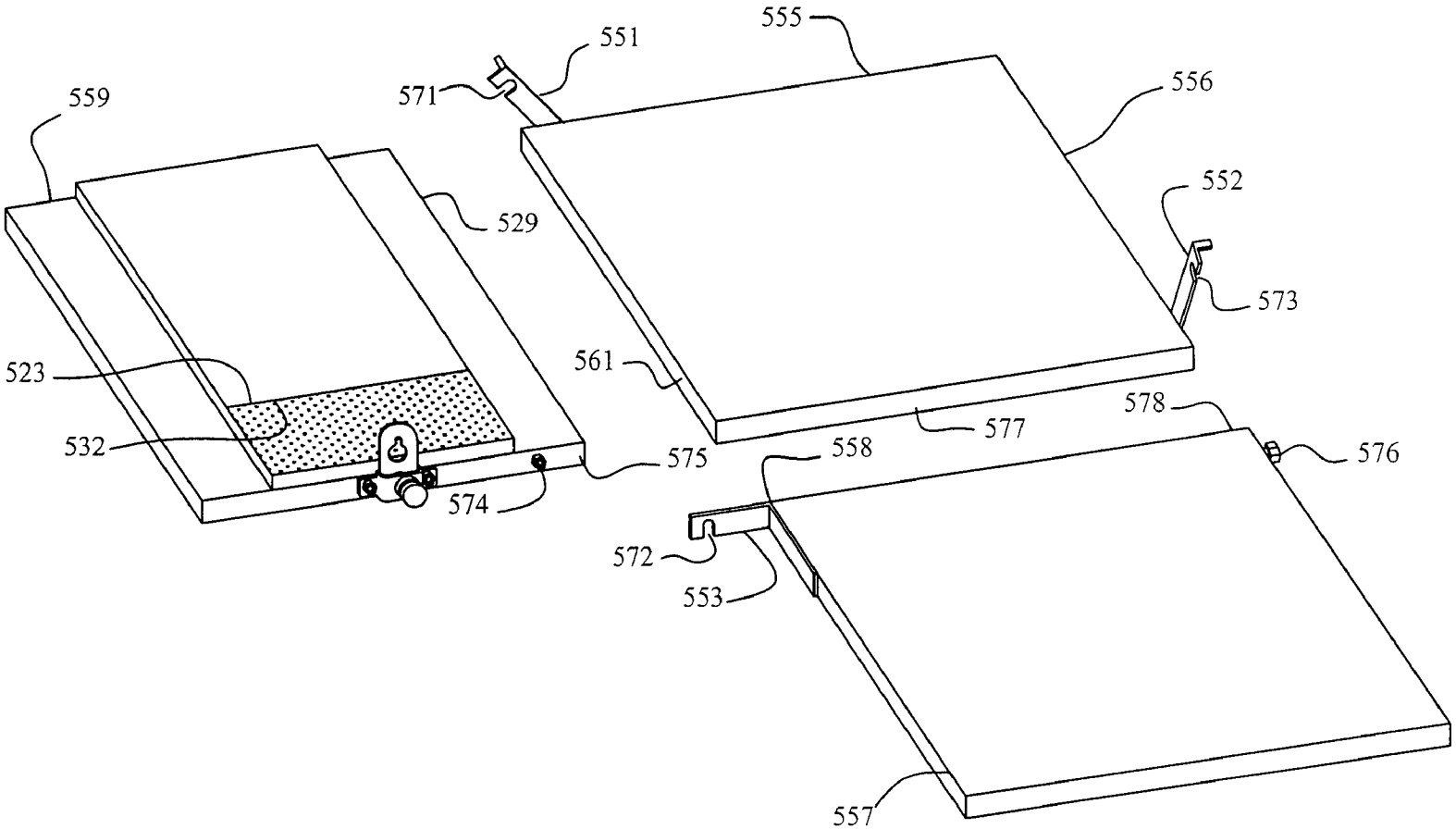

Referring to FIGS. 15, 16 and 17, a section of ¾-inch plywood 530 is attached to the top surface of the swing-platform base 500. The plywood section 530 has an edge 532 the length of which equals the width of the turf mat 520. When attached to the top surface of the swing-platform base 500, the edge 532 of the plywood section 530 butts up against a rear edge 523 of the turf mat 520. In a preferred embodiment of the present invention, a left-foot standing platform 560 and a right-foot standing platform 565 is attached to the swing-platform base 500. The left-foot standing platform 560 is provided with a left-hand and a right-hand latch mechanism 551 and 552, respectively. At an extreme end of the left and right-hand latch mechanism, a bore (not shown) is provided which allows said latch mechanisms to be pivotally attached to a side face 555 and 556 near diagonal corners of the left-foot standing platform 550. The right-foot standing platform 565 has a non-pivotal, ninety-degree angle, latch 553 attached to a side 557 near a corner 558 of said right-foot standing platform. The left-hand latch mechanism 551 has an opened-ended slot 571 at an extreme end that pivotally engages a hanger bolt (not shown) perpendicularly projecting from a rear face 559 of the swing-platform base when a front edge 561 of the left-foot standing platform 560 butts up against a side edge 529 of the swing-platform base 500. Likewise, the angled latch mechanism 553 and the right-hand latch mechanism 552 have an open-ended slot 572 and 573, respectively. The slot 572 first engages a projecting portion of a hanger bolt 574 near a corner 575 of the swing-platform base 500 after which the slot 573 pivotally engages a projecting portion of a hanger bolt 576 pulling together edges 577 and 578 of the left and right-foot standing platforms, respectively (FIG. 15) The extreme end of each projecting hanger bolt have threaded thereon a nut (not shown) the inside face of which provides a gap (not shown) with the opposing face of which the hanger bolt extends. The gap width dimension is slightly greater than the thickness of the latch mechanisms it receives. Referring to FIG. 16, in an alternate embodiment of the preferred invention a single standing platform 590 connects with the swing-platform base 500 using an angle pivoting latching mechanism (not shown). The top surfaces of the swing-platform base and the standing platforms are covered with carpet 900.

Figure 21:
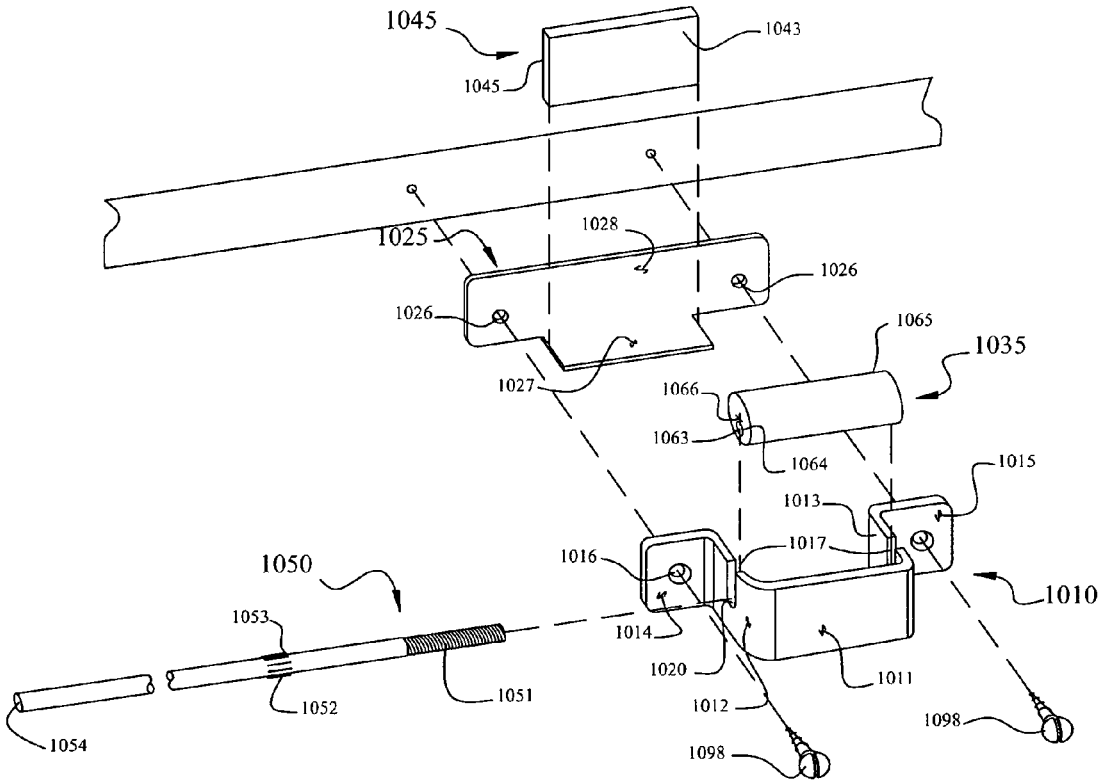
FIG. 21 is an exploded view of portions of an alternate preferred embodiment mount of the present invention.

Referring to FIG. 21, a stationary target-holder is provided, consisting of a fixed target-holder frame 1010, a fixed target-clamp plate 1025, and a cam actuated target-clamp mechanism 1035. The fixed target-holder frame 1010 has a front vertical part 1011 that is perpendicular with two opposing side parts, a left-side part 1012 and a right-side part 1013. The left and right side parts, 1012 and 1013, respectively, bend outwardly to form two coplanar front vertical parts, a left-front vertical part 1014, and a right-front vertical part 1015, that offset with the front vertical part 1011. The planar area of the left-front and right-front vertical parts 1014 and 1015, respectively, each has a centrally located tapered bore 1016. The opposing left-side part 1012 and right-side part 1013 of the fixed target-holder frame 1010 has a slot 1017 that intersects with a top edge 1018 of said left and right side parts, 1012 and 1013, respectively. The slots 1017 have a semi-circular bottom 1020 that becomes a fulcrum about which the cam actuated target-clamping mechanism 1035 is rotated.

Referring to FIG. 21, the inventive stationary target-holder, fixed target-clamp plate 1025 has a pair of bores 1026. The fixed target-clamp plate 1025 has a bottom horizontal part 1027 that forms a ninety-degree angle adjacent with a vertical front part 1028. A friction pad 1045, made from a ¼-inch thick neoprene material, has a rear side 1044 that is adhered to a front side of the vertical part 1028 of the fixed target-clamp plate 1025. The bottom horizontal part 1027 of the fixed target-clamp plate 1025 is planar and has a length equal to a length of the friction pad 1045. The bottom horizontal part 1027 widthwise extends beyond a front side 1043 of the friction pad 1045.

Referring to FIGS. 21, 22, 22*a* and 23*b*, the inventive cam actuated target-clamp mechanism 1035, of the stationary target-holder mechanism, has a pivot rod 1050, having a circular cross section. An extreme end 1051 of the pivot rod 1050 is threaded with ¼×20 pitch threads, and an opposite extreme end 1054 is not threaded. A middle section 1052 of the pivot rod 1050 has spline-like projections 1053 about the circumference of said pivot rod 1050. The pivot rod 1050 is sufficiently long and extends beyond a left side 1094 and right side 1096 of a swing-platform base 1095. The circular bar 1065, made from a polymeric material, is pressed onto the pivot rod 1050. The circular bar 1065 has a longitudinal bore 1064 that has a center 1063 that is eccentric with a symmetrical axis 1066 of the circular bar 1065. The spline-like projection 1053 of the pivot rod 1050 prevents the circular bar 1065 from rotating about the pivot rod 1050.

Figure 22:
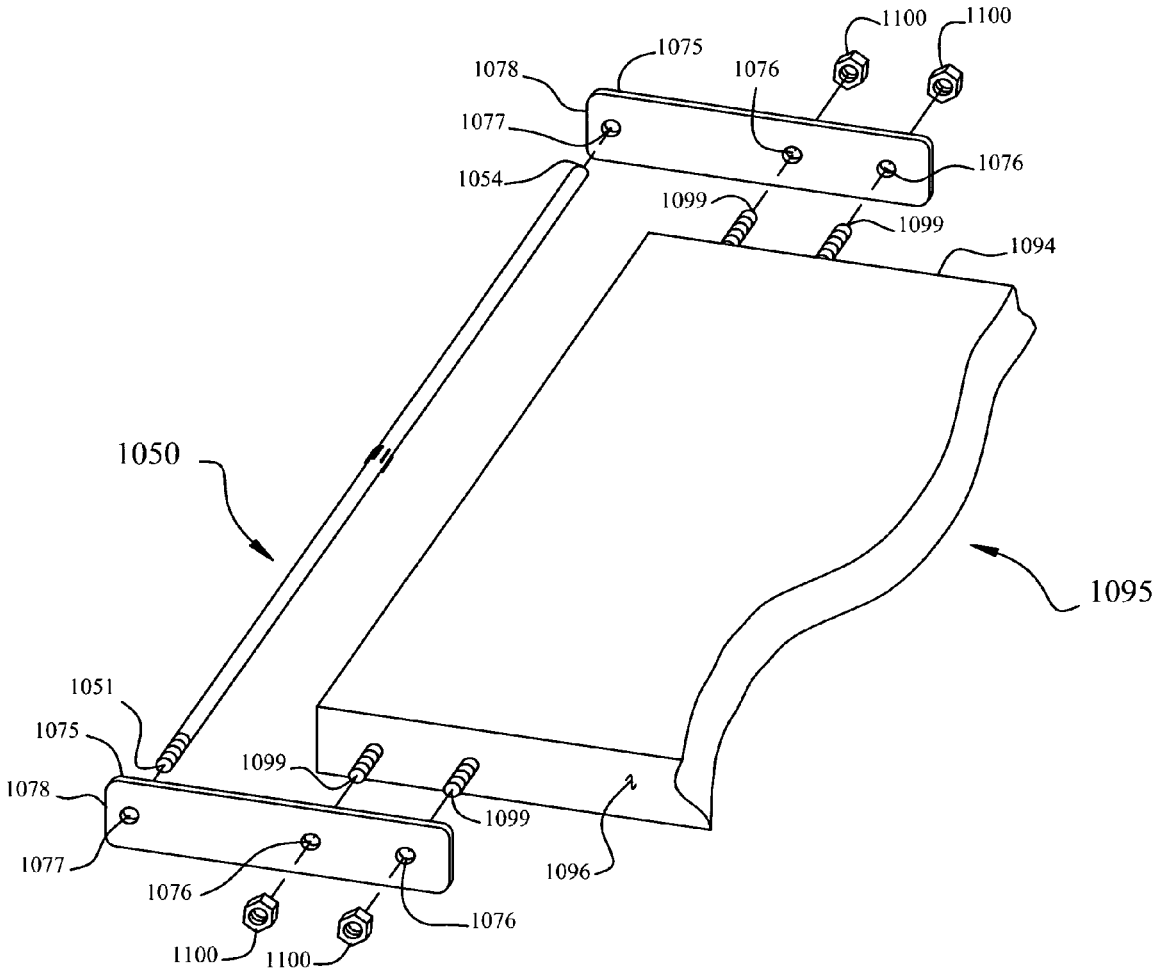
FIG. 22 is a perspective view of a portion of the mount shown in FIG. 21.

Referring to FIG. 22, the inventive cam actuated target-clamp mechanism 1035, of the stationary target-holder, has a left and a right pivot arm 1075, that is approximately ¾-inch wide and 2.5-inches long. The pivot arm 1075 has a pair of bores 1076, and a third bore 1077. The pair of bores 1076 and the third bore 1077 have centers that are concentric and coaxial with a longitudinal symmetrical axis of the pivot arm 1075. The third bore 1077 is located near an edge 1078 of the pivot arm 1075.

Figure 24:
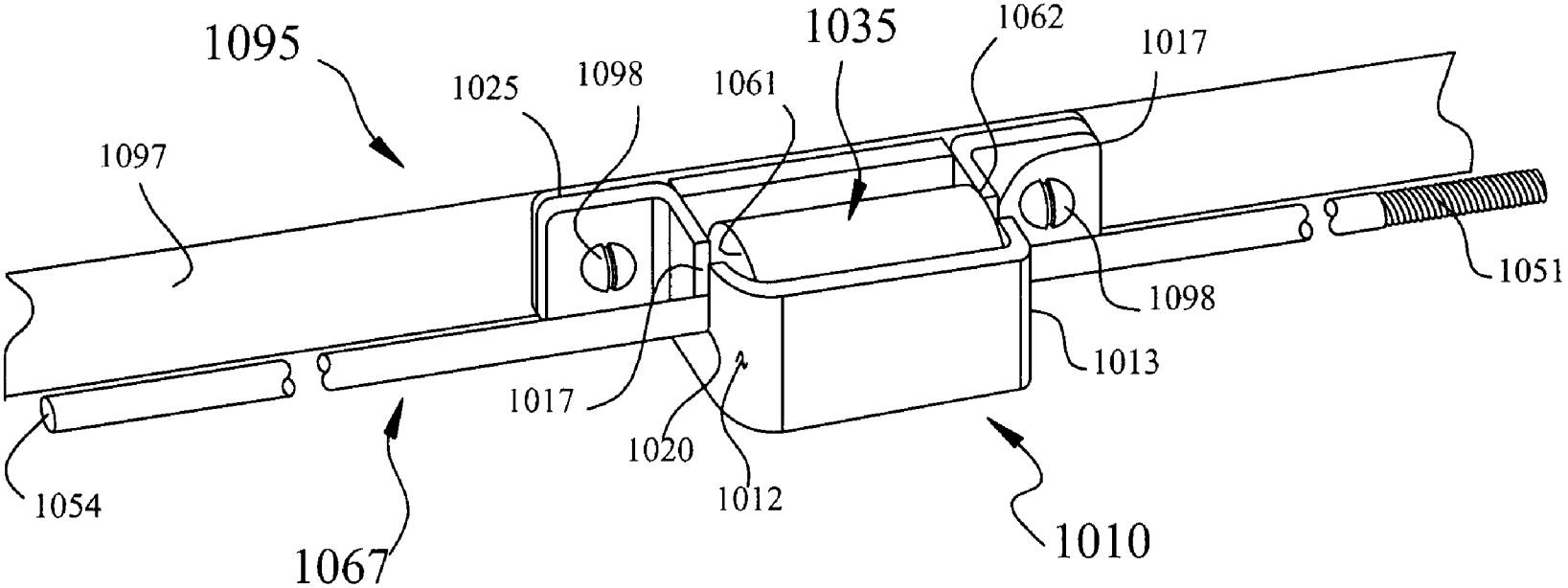
FIG. 24 is a perspective view of mount shown in FIG. 21.

Referring to FIGS. 21, 22 and 24, the fixed target-holder frame 1010, the fixed target-clamp plate 1025 and the cam actuated target-clamp mechanism 1035 are assembled to a front side 1097 of the swing-platform base 1095, midway between the left side 1094 and the right side 1096 of said swing-platform base 1095. The fixed target-clamp plate 1025 and the fixed target-holder frame 1010 are attached to the front side 1097 of the swing-platform base 1095 by means of a screw fastener 1098 inserted through the aligned bores 1016 and 1026 of said target-holder frame 1010 and said target-clamp plate 1025, respectively. The cam assembly 1067, left side 1061 and right side 1062, fit between the left and right side parts 1012 and 1013, respectively, of the fixed target-holder frame 1010. The cam assembly 1067 is thereby supported on semi-circular fulcrum 1020 of slots 1017. The extreme end 1051 and 1054 of the pivot rod 1050 extend beyond the left side 1094 and right side 1096 of the swing-platform base 1095 where said extreme ends 1051 and 1054 are received by the third bore 1077 of a pivot arm 1075. The bores 1076 within the pivot arm 1075 are received by a pair of hanger bolts 1099 extending perpendicularly from the left and right sides 1094 and 1096, respectively, of the swing-platform base 1095. The pivot arms 1075 are subsequently secured against the respective sides of the swing-platform base 1095 with a nut screw fastener 1100.

Figure 23A:
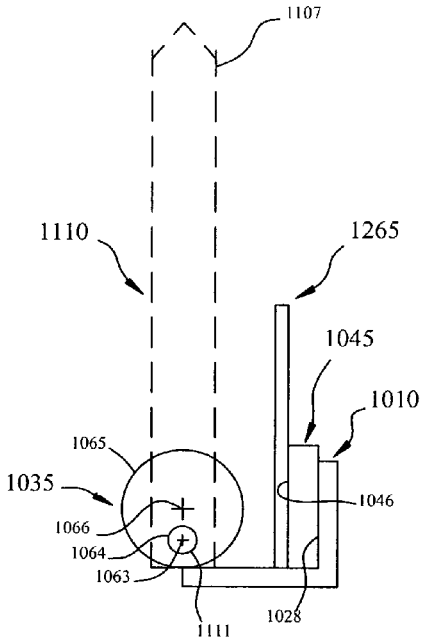
FIGS. 23*a* and 23*b* are side elevational views of mount shown in FIG. 21.
Figure 23B:
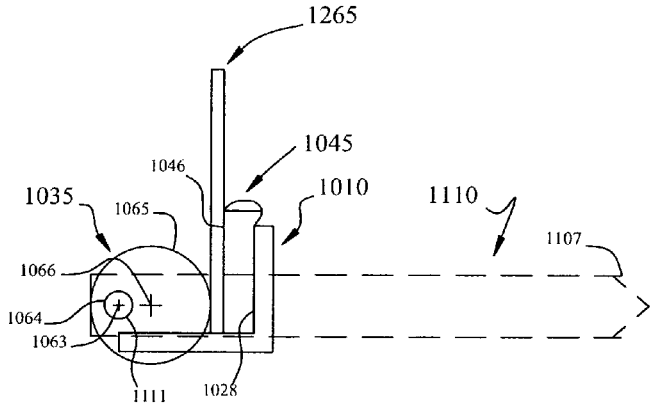
Figure 25A:
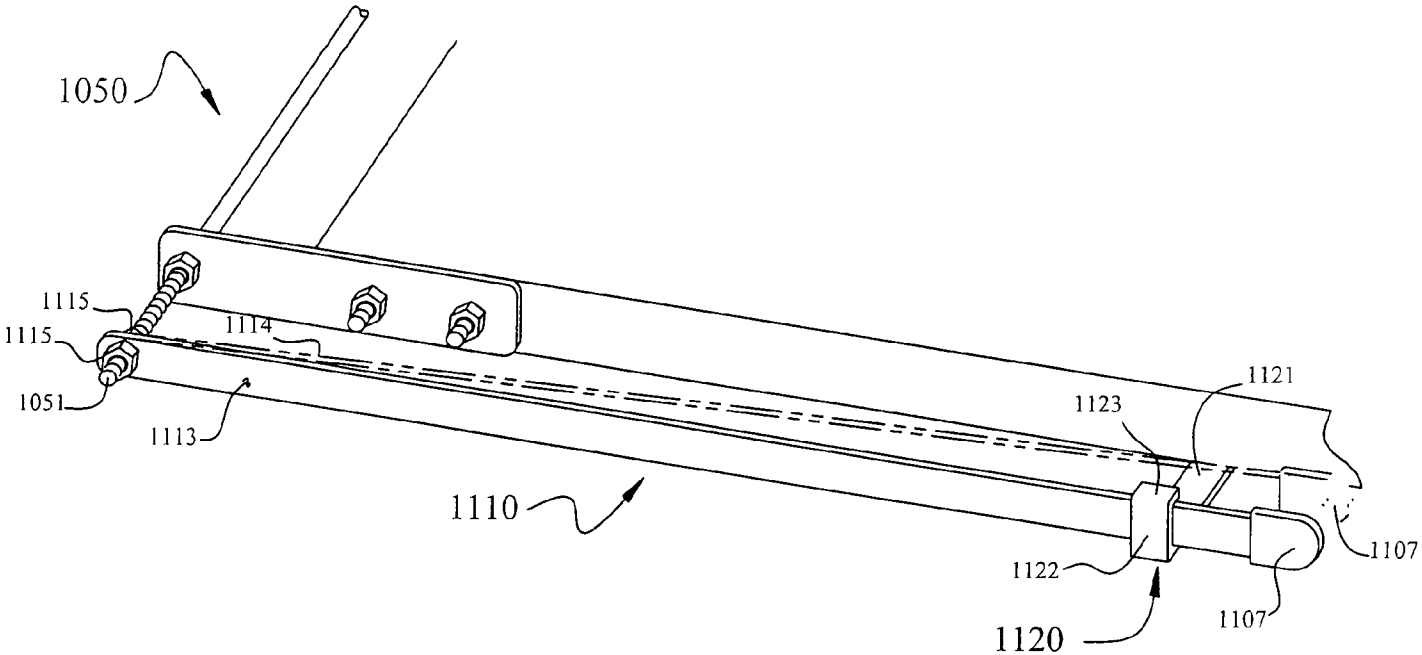
FIGS. 25*a* and 25*b* are perspective views of portions of the mount shown in FIG. 21.
Figure 25B:
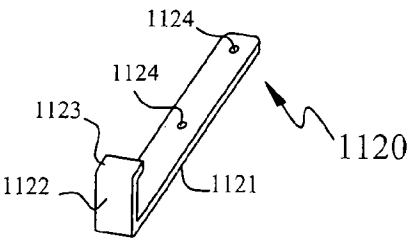

Referring to FIGS. 25*a* and 25*b*, the inventive cam actuated target-clamp mechanism, of the stationary target-holder mechanism, has a steel cam lever 1110, ⅛-inch thick by one-inch wide, that is screwed onto the threaded end 1051 of the pivot rod 1050. The cam lever 1110 has a bore 1111 at a bottom edge 1109. The bore 1111 is threaded with ¼×20-pitch threads and said bore center is perpendicular and concentric with a longitudinal axis of the cam lever 1110. The cam lever 1110 other extreme end is covered with a cap 1107 made from a vinyl material or other suitable materials. The cam lever 1110 is prevented from rotating about the pivot rod 1050 with a pair of nut fastener 1115 that sequentially locks against a front side 1113 and a rear side 1114 of the cam lever 1110. Referring to FIG. 23*a*, when the cam lever 1110 is rotated counter clockwise to a vertical upright position a practice target 1265 can be inserted into the fixed target-holder frame 1010 between the friction pad 1045 and the cam 1065 of the cam actuated target-clamp mechanism. The cam lever 1110 is then rotated clockwise to a horizontal position, FIG. 23*b*, thereby rotating the cam 1065 against the practice target 1265 frontal surface thus compressing said practice target 1265 against a front side 1046 the friction pad 1045. The target 1265 is now frictionally held in position adjacent a lower end of the target 1265.

Referring to FIGS. 25*a* and 25*b*, cam lever 1110 of the inventive cam actuated target-clamp mechanism connects with a latch 1120. The latch 1120 has a first straight part 1121, a second straight part 1122 and a third straight part 1123. The first straight part 1121 and the third straight part 1123 are parallel and form a ninety-degree angle with the second straight part 1122. The first straight part 1121 has a pair of bores 1124, the center of which are coaxial and concentric with a symmetrical longitudinal axis of said first straight part 1121. The inside distance between the first part 1121 and second part 1122 is sufficiently wide to contain the width of the cam lever 1110.

Figure 26:
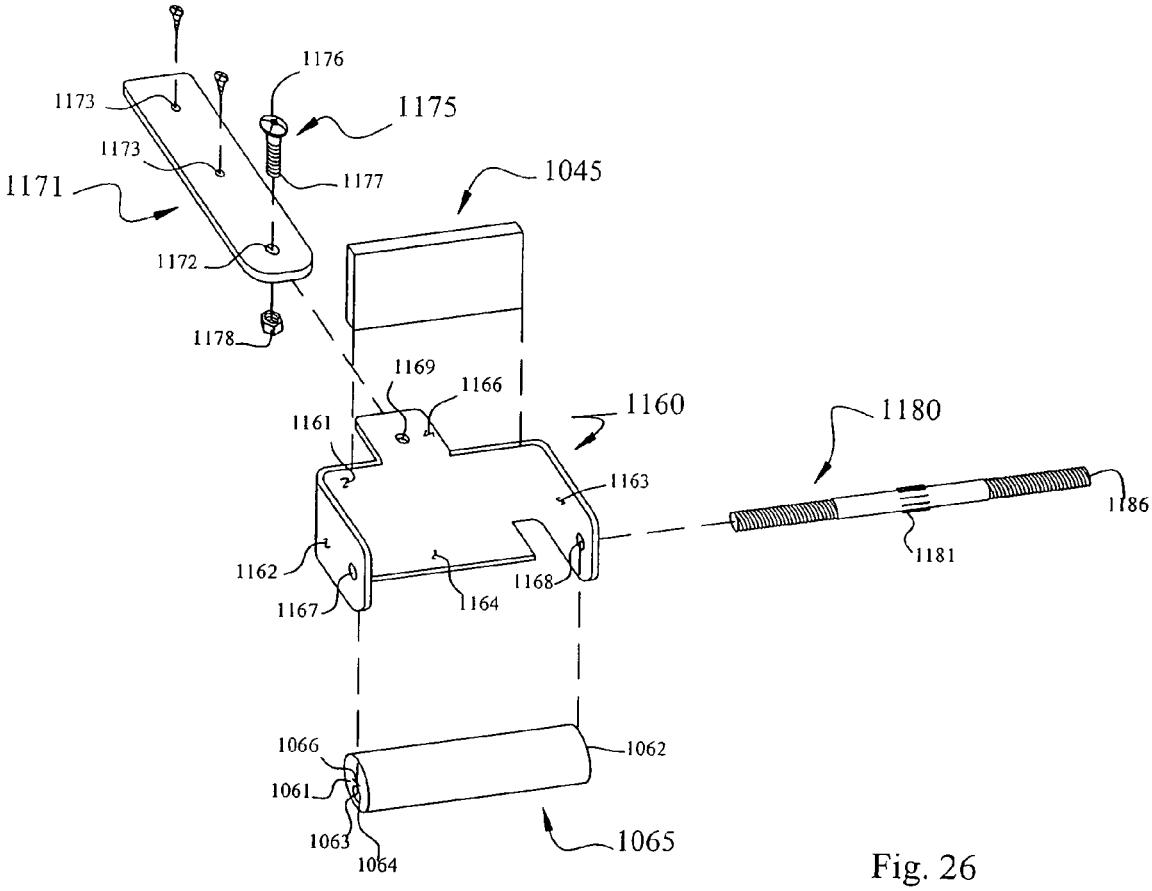
FIG. 26 is an exploded view of another alternate preferred embodiment mount of the present invention.
Figure 27:
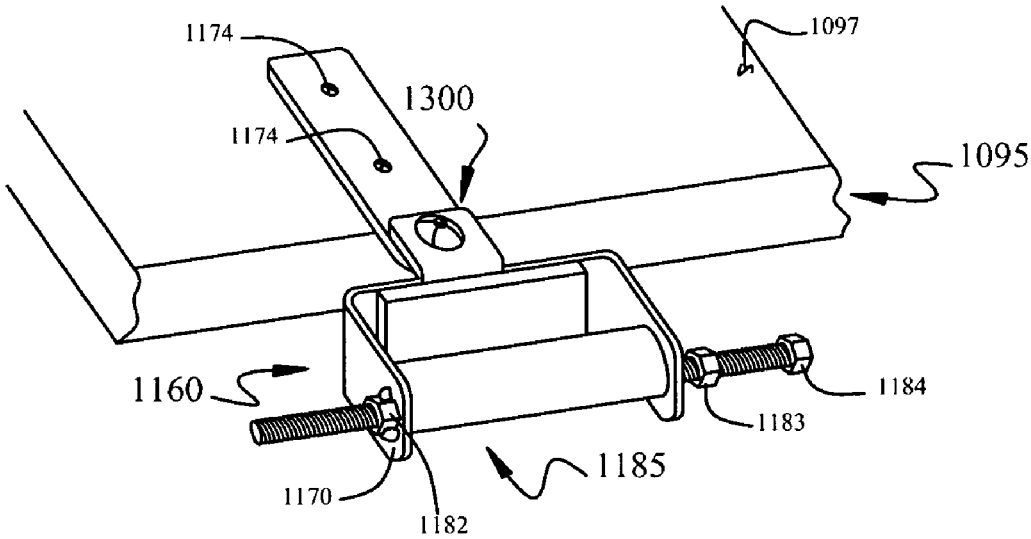
FIG. 27 is a perspective view of the mount shown in FIG. 26.

Referring to FIGS. 26 and 27, a vertically pivoting target-holder mechanism 1300, comprises a pivoting target-holder frame 1160, and a cam actuated target-clamp mechanism 1185. The pivoting target-holder frame 1160 has a vertical front part 1161 that is perpendicular with two opposing side parts, a left-side part 1162, and a right-side part 1163. The vertical front part 1161 of the pivoting target-holder frame 1160 is also perpendicular with a forward projecting bottom horizontal part 1164. Likewise, the vertical front part 1161 is perpendicular with a rearward projecting top horizontal part 1166 of the pivoting target-holder frame 1160. The left-side part 1162 and the right-side part 1163, each has a bore 1167 and 1168, respectively. The rearward projecting top horizontal part 1166 of the pivoting target-holder frame 1160 also has a bore 1169.

Referring to FIG. 26, the rectangular friction pad 1045 rear face is adhered to the vertical front part 1161 of the pivoting target-holder frame 1160. In the embodiment of the inventive vertically pivoting target-holder mechanism 1300, a pivot arm 1171 has a pivot bore 1172 and a pair of bores 1173 of which a pair of screw fasteners 1174 are received to mount said pivot arm 1171 to a top surface 1097 of the swing-platform base 1095. The pivot bore 1172, of the pivot arm 1171, receives a pivot pin 1175 of which an extreme end has a head 1176 and another extreme end 1177 is threaded. The pivot pin 1175 assembles initially through the bore 1169 of the rearward projecting horizontal top part 1166 of the pivoting target-holder frame 1160 and secondly through the pivot bore 1172 of the pivot arm 1171. A nut fastener 1178 is provided to complete the assembly of the vertically pivoting target-holder mechanism 1300.

Referring to FIGS. 26 and 27, the inventive cam actuated target-clamp mechanism 1185, of the vertically pivoting target-holder mechanism 1300, has a pivot rod 1180 having a short length of ¼×20 pitch threads at both extreme ends. The previously described circular bar 1065 is used for assembly onto the short pivot rod 1180. The spline-like projections 1181 of the pivot rod 1180 provides a tight fit with the bore 1064 of the circular bar 1065, thus preventing said circular bar 1065 from rotating about said pivot rod 1180. In the present embodiment of the vertically pivoting target-holder mechanism 1300, the inventive cam actuated target-clamp mechanism 1185 has a first nut 1182 that is welded to a left outside face 1170 of the pivoting target-holder frame 1160 after said first nut 1182 is threaded onto the pivot rod 1180. A second and a third nut 1183 and 1184, respectively, are threaded onto a right extreme end 1186 of the pivot rod 1180. The third nut 1184 is welded onto the extreme end 1186 of the pivot rod 1180.

Figure 28:
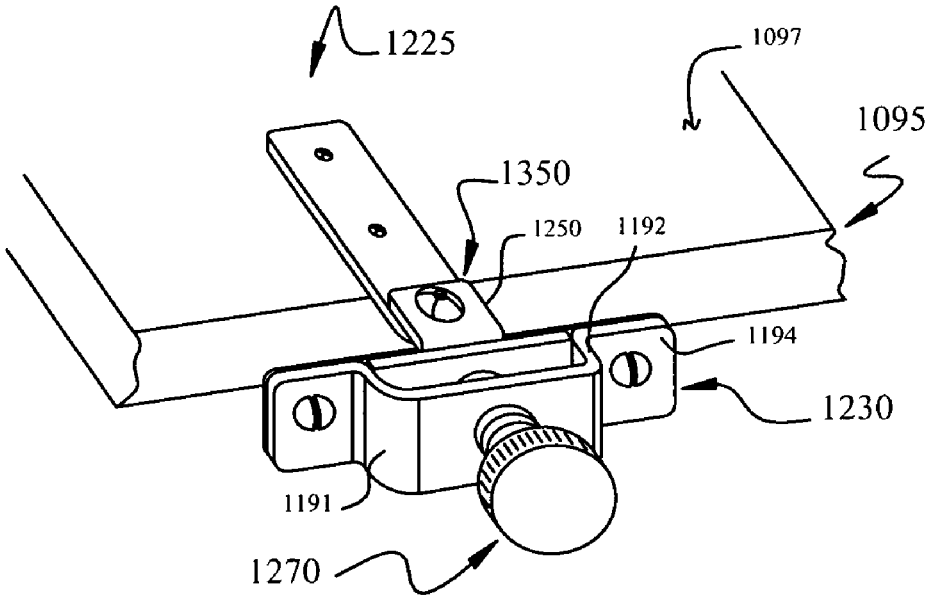
FIG. 28 is a perspective view of another alternate preferred embodiment mount of the present invention.
Figure 29:
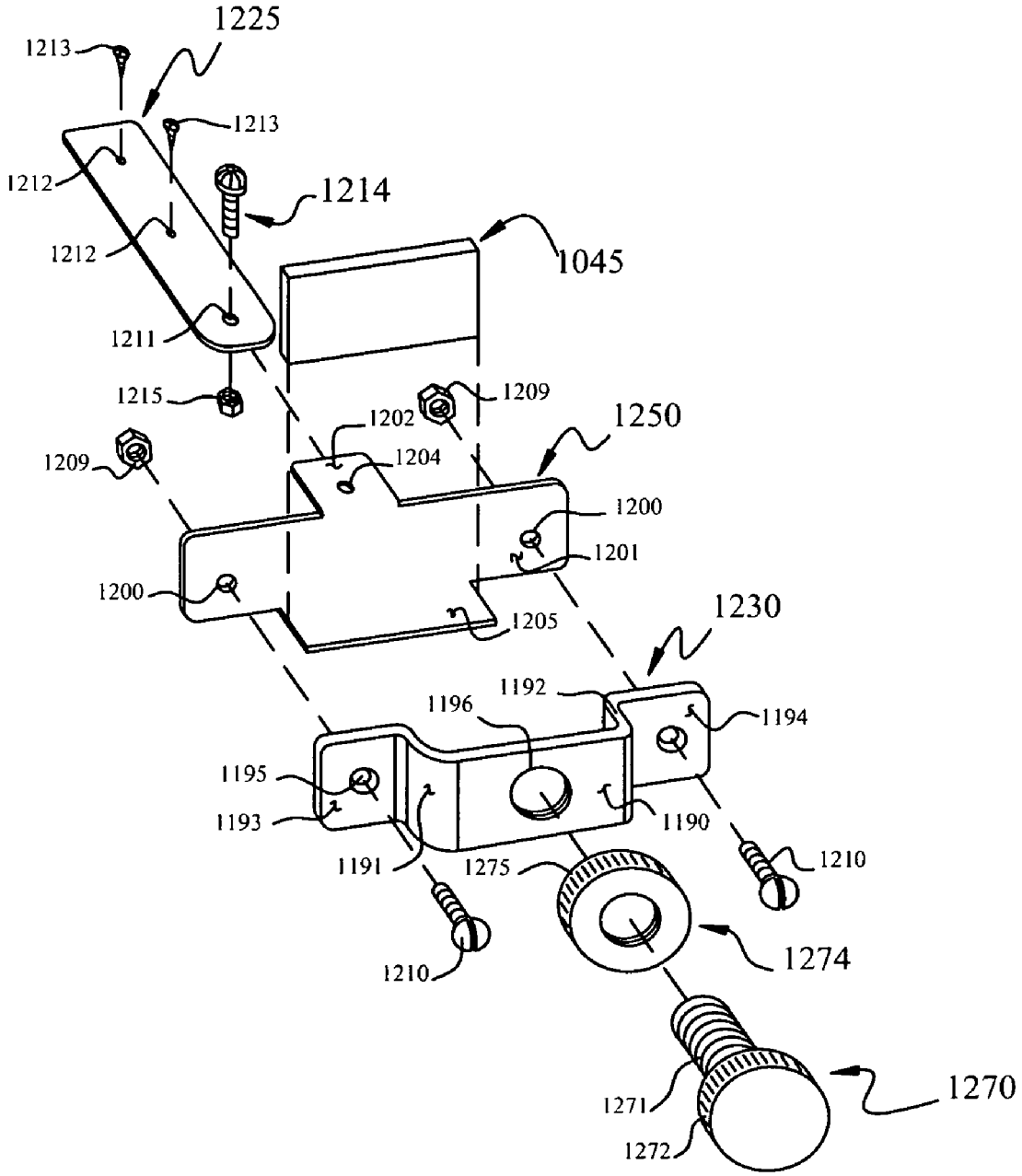
FIG. 29 is an exploded view of the mount shown in FIG. 28.

Referring to FIGS. 28 and 29, an alternate embodiment of a vertically pivoting target-holder mechanism 1350, consists of a target-holder frame 1230, a pivoting target-clamp plate 1250 and a target-clamp screw 1270. The target-holder frame 1230 has a vertical front part 1190 that is perpendicular with two opposing side parts, a left-side part 1191, and a right-side part 1192. A left-front part 1193 and a right-front part 1194 are coplanar and adjacent with the left and right side parts 1191 and 1192, respectively, of the target-holder frame 1230. The left-front and right-front parts 1193 and 1194, respectively, are parallel with the front part 1190. The planar area of the left-front part 1193 and the right-front part 1194 have a bore 1195 centrally located there about. The forward projecting front face 1190 has a ⅝×11 pitch threaded bore 1196 that receive a target-clamp screw 1270. The target-clamp screw 1270 having a knob 1272, has likewise at an extreme end ⅝×11 pitch threads 1271. A thin disk 1274 having a threaded bore is screwed onto the target-clamp screw 1270 and said disk 1274 has a surface 1275 that stops against a frontal surface 1190 of the target holder 1230. The disk 1274 is provided to set a predetermined clamp load against a practice target.

Referring to FIGS. 28 and 29, the inventive pivoting target-clamp plate 1250, of the alternate embodiment of a vertically pivoting target-holder mechanism 1350, has a pair of bores 1200 within a vertical front part 1201. The pivoting target-clamp plate 1250 has a horizontal top part 1202 that has a bore 1204, and a horizontal bottom part 1205, both of which are planar. The top part 1202 forms a ninety-degree angle adjacent with a rear side of the vertical front part 1201. The bottom part 1205 forms a ninety-degree angle adjacent with a front side of the vertical front part 1201. The bores 1200 of the vertical front part 1201 of the target clamp-plate 1250 and the bores 1195 of the target-holder frame 1230 align to each receive a fastener 1210. The assembly of the target clamp-plate 1250 with the target-holder frame 1230 is held together with a nut fastener 1209 screwed onto an extreme end of each said fastener 1210.

Referring to FIGS. 28 and 29, the alternate inventive vertically pivoting target-holder mechanism 1350, has a pivot arm 1225 that has a pivot bore 1211 and a pair of bores 1212. The bores 1212 receive a screw fastener 1213 to attach the pivot arm 1225 to the top surface 1097 of a swing-platform base 1095. The pivot bore 1211 of the pivot arm 1225 align with the bore 1204 of the target clamp-plate 1250 to receive a pivot pin 1214. The assembly of the pivot arm 1225 and the target-clamp plate 1250 is held pivotally together with a nut fastener 1215 screwed onto an extreme end of the pivot pin 1214.

Figure 30:
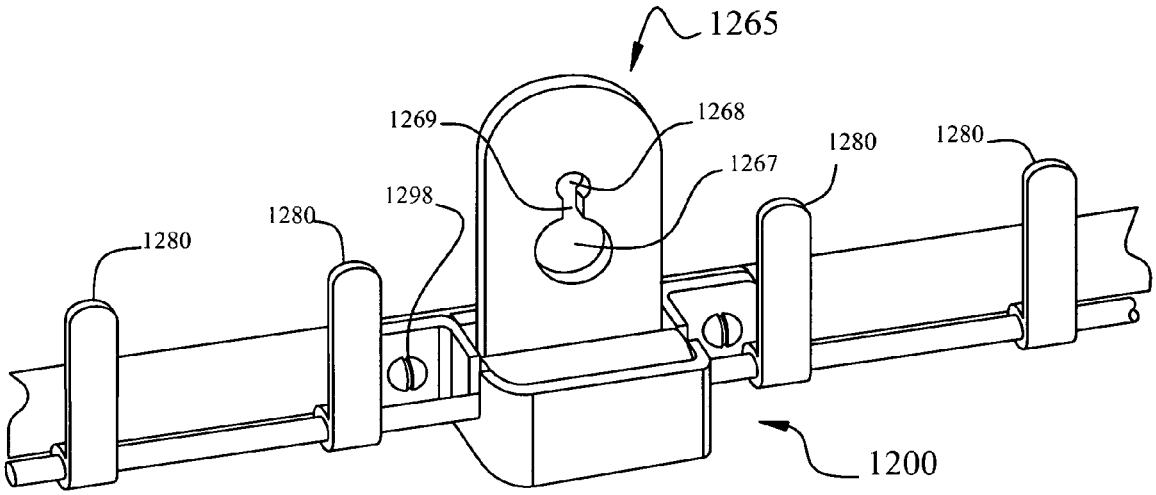
FIG. 30 is a perspective view of the mount shown in FIG. 24 along with dummy targets.

Referring to FIG. 30, a practice target 1265 is typically planar and fabricated from a polymeric or other suitable material. In the embodiment of a present inventive practice target, a practice target 1265 is made of an Ultra-High Molecular Weight (UHMW) polyethylene material having a thickness range of 0.085-0.135 inch. The practice target 1265 has a width slightly narrower than an inside dimension of opposing left and right sides of a target-holder frame. A length of the practice target is determined by the location of a lower aperture 1267 relative to the top surface of a turf mat attached to a top surface of a swing-platform base. The lower aperture 1267 along an upper edge thereof opens to with a preferably smaller upper aperture 1268 by means of a narrowing or slot 1269.

Referring to FIG. 30, a stationary target-holder mechanism 1200 is provided, with optional 'dummy' targets 1280 that are made from Ultra-High Molecular Weight (UHMW) polyethylene material. Unlike the practice target 1265, which is fixed from rotation in the embodiment of the present inventive stationary target-holder mechanism 1200, the 'dummy' targets 1280 are free to rotate about the pivot rod 1050. The dummy targets 1280 give an indication to the user that their swing is grossly off the mark. The dummy targets 1280 are highly useful when instructing child golfers.

Figure 31:
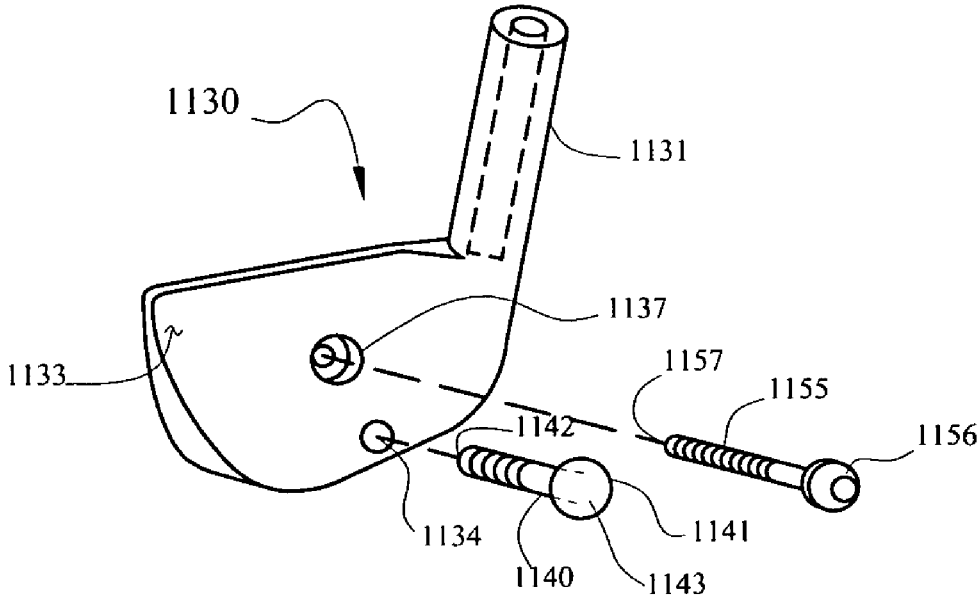
FIGS. 31 and 32 are perspective front and rear views of an alternate preferred embodiment golf club used with the present invention.
Figure 32:
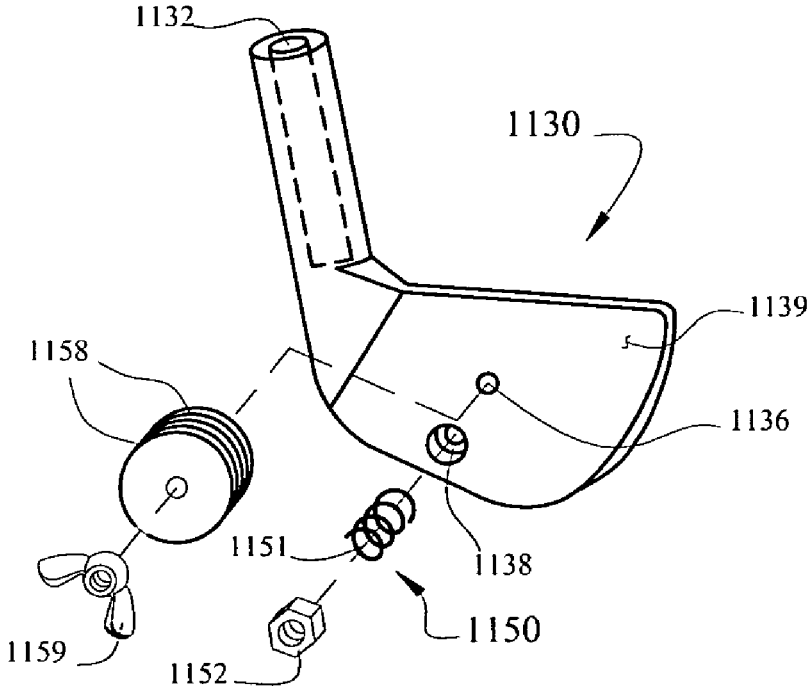
Figure 33:
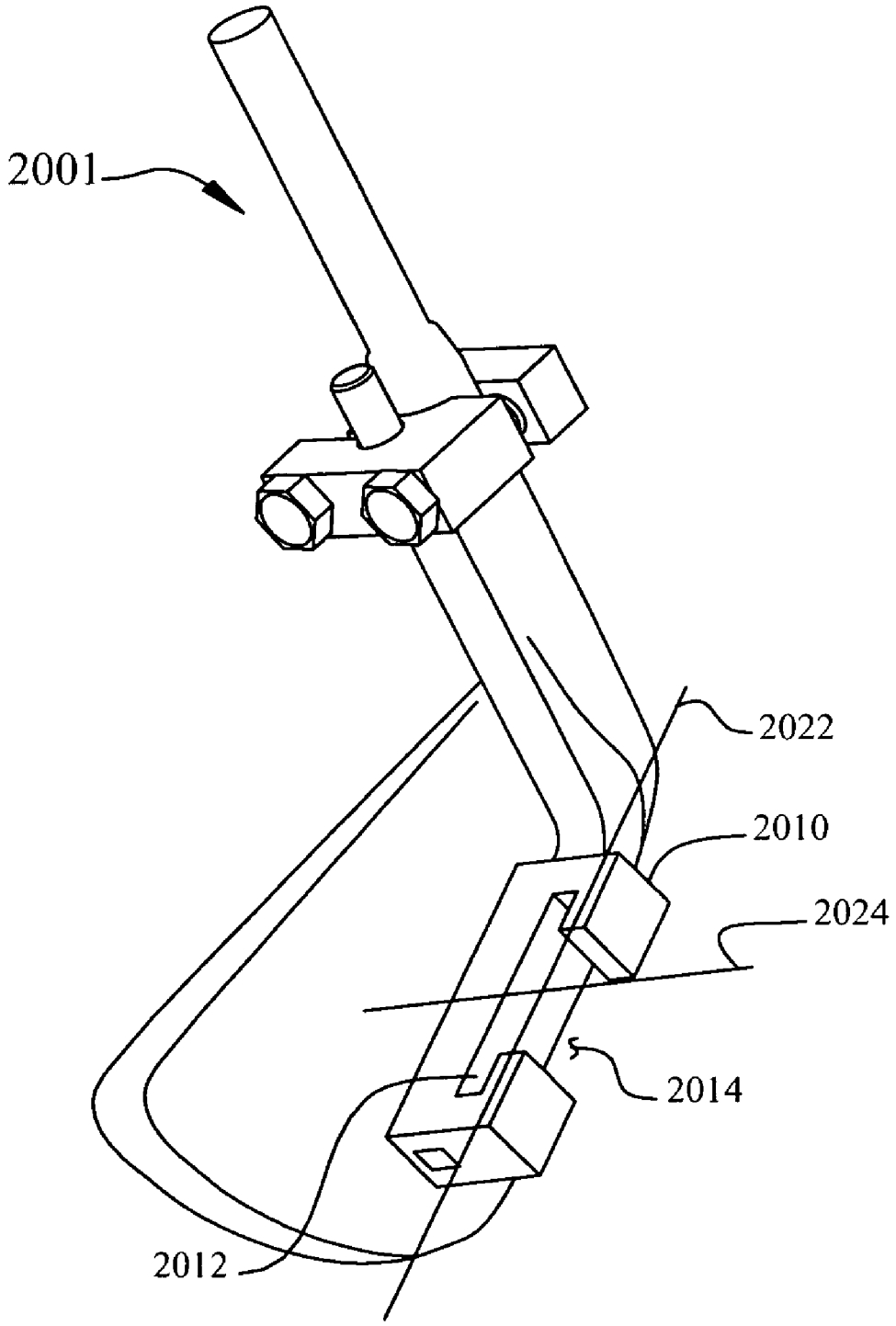
FIG. 33 is a perspective view of another alternate preferred embodiment golf club used with the present invention.
Figure 34:
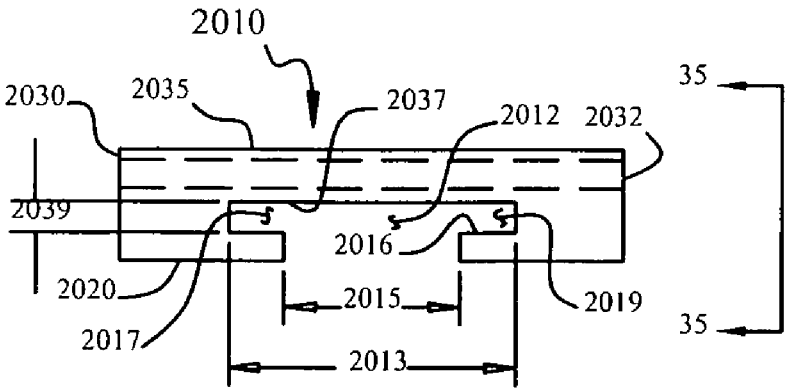
FIGS. 34 and 35 are top plan and side elevational views of a portion on the golf club shown in FIG. 33.
Figure 35:
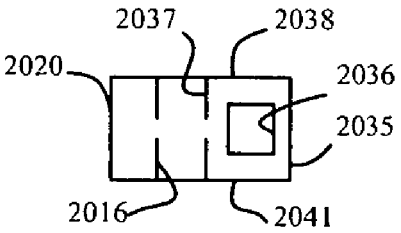
Figure 36:
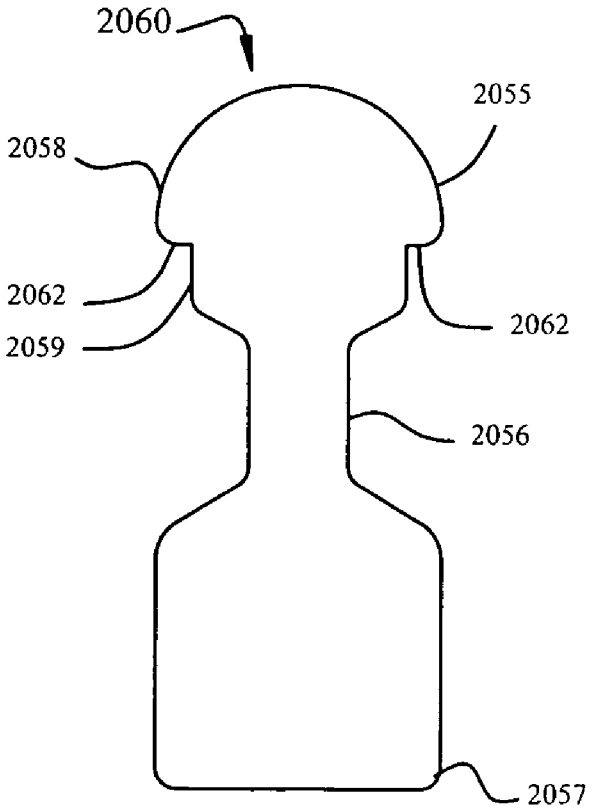
FIG. 36 is a front elevational view of a target used with the golf club of FIG. 33.

Referring to FIGS. 31 and 32, a practice golf club head 1130, is provided made of a polymeric material. Compliantly mounted or spring loaded with respect to the shaft of the golf club (not shown) via the head 1130 is a target-hook latch mechanism. The shaft (not shown) may be plastic, metal, composite, or other suitable material. The polymer-club head 1130 has a hosel 1131 that has a longitudinal blind bore 1132 about the symmetrical axis of said hosel. The polymer-club head 1130 has a front face 1133 having a lower bore 1134 near a bottom edge 1135 and an upper bore 1136 the center of which aligns with that of the lower bore 1134. The upper bore 1136 has a concentric counter bore 1137. The lower and upper bores 1134 and 1136, respectively, open to a rear side 1139 of the polymer-club head 1130. The rear side 1139 and the longitudinal axis of the hosel 1131 are parallel. Conversely, the front face 1133 and the longitudinal axis of the hosel 1131 intersect at a shallow angle. The rear side 1139 of the polymer-club head 1130 has a shallow counter bore 1138 concentric with lower bore 1134.

The second bore 1136 of the polymer-club head 1130 receives a fastener 1155 having ¼×20 pitch threads. The fastener 1155 has a head 1156 that is received by the bore 1137 of the polymer club-head 1130 when an extreme end 1157 of said fastener 1155 is inserted through the bore 1136 of said polymer club-head 1130. The extreme end 1157 of the fastener 1155 extends form the rear side 1139 of the polymer-club head 1130 a sufficient length. A disk 1158 having a ¼-inch diameter center bore and a one-inch outer diameter is sufficiently thin such that many disks 1158 can be received by the length of the fastener 1155 that extends perpendicularly beyond the rear side 1139 of the polymer club-head 1130. In the embodiment of the present inventive polymer-club head 1130, multiple thin disks 1158 are externally mounted to increase the weight of an otherwise inherently lightweight polymer-club head 1130. The disks 1158 are securely fastened to the extended part of the fastener 1155 against the rear side 1139 of the polymer-club head with a nut fastener 1159.

The spring loaded target hook latch mechanism, has a ¼-inch diameter steel dowel rod 1140, having a series of spline-projections (not shown) at an extreme end and ¼-20 pitch threads at an opposite end 1142. A spherical knob 1141 is provided having a blind bore (not shown) that allows the spherical knob 1141 to be pressed over the spline-projections 1143 at the extreme end of the dowel rod 1140. The spherical knob 1141 has a diameter that is preferably at least two times larger than the ¼-inch diameter of the dowel rod 1140. The diameter of the lower bore 1134 within the polymer-club head 1130 is larger than the diameter on the dowel rod 1140 thereby when the dowel rod 1140 is inserted within the lower bore 1134 a clearance fit is provided. The extreme end 1142 of the dowel rod 1140 is sufficiently long such that the extreme end 1142 projects a significant distance from the rear side 1137 of the polymer-club head 1130. The shallow counter bore 1138 within the rear side of the polymer-club head 1130, is sufficiently large to receive an outer diameter of a compression spring 1150. The counter bore 1138 also has a sufficient depth to pilot a lower coil of the compression spring 150. The compression spring 1150 has a free length that is sufficiently long such that an extreme end 1151 extends beyond the extreme end 1142 of the dowel rod 1140. The compression spring 1150 is variably compressed to an installed height using a nut fastener 1152 whereby the nut fastener 1152 is threaded onto the extreme end 1142 of the dowel rod 1140. At a given installed height of the compression spring 1150, a spring force maintains contact of the spherical knob 1141 with the front face 1133 of the polymer-club head 1130.

In operation, upon a proper swing at a defined level of expertise, the spherical knob 1141 will penetrate the aperture 1267 and as the club swing continues, the spherical knob 1141 will pull upward on the target 1265. The target, as it is being pulled upon, causes the spherical knob 1141 to be displaced outward from the club face compressing spring 1150 and allowing the dowel rod 1140 to pass through the slot 1169. The dowel rod 1140 then enters the aperture 1268 as the compression spring 1150 returns the spherical knob 1141 against the club face. The aperture 1268 is ideally larger than the diameter of the dowel rod 1140 and smaller than the diameter of the spherical knob 1141. The spherical knob captures the target 1265 removing it from its target-holder mechanism. The spring compresses and thereby retains the target 1265 against the club face 1133 of the polymer-club head 1130 along an interface greater than 180 degrees.

Referring to FIGS. 33-36, a golf club 2001 with a ring member or target-hook clasp 2010 is shown having a slot 2012 and a predefined opening 2014. The opening 2014 intersects with a front side, depicted by an edge 2020, of the target-hook clasp 2010 and connects with the slot 2012 through a front side, depicted by an edge 2016 of the slot 2012. The centerlines of the opening 2014 and the slot 2012 are perpendicular with a longitudinal axis 2022 and coincident with a symmetrical axis 2024 of the target-hook clasp 2010. The opening 2014 and the slot 2012 are parallel lengthwise with the longitudinal axis 2022 of the target-hook clasp 2010. The slot 2012 has a length 2013 that is greater than a length 2015 of the opening 2014 thus providing a left and a right portion 2017 and 2019, respectively. A transverse width 2039 of the slot 2012 is slightly greater than a transverse 2056 thickness of a connection member provided by a reduced portion of a practice target 2060. A longitudinal bore 2036 is located between a rear side of the target-hook clasp 2010, corresponding to an edge 2035, and a rear side of the slot 2012, corresponding to an edge 2037. The longitudinal bore 2036 has a square-cross section the extreme end of which intersects with a left and a right side of the target-hook clasp 2010, corresponding to an edge 2030 and 2032, respectively. The slot 2012 and the opening 2014 intersect with a top and bottom face of the target-hook clasp 10, corresponding to an edge 2038 and an edge 2041, respectively. The longitudinal bore 2036 is located midway between the top and bottom edges 2038 and 2041, respectively.

The practice target 2060 is provided having an enlarged top extreme portion 2055, a juxtaposing reduced portion 2056, and an enlarged bottom extreme portion 2057. The reduced portion 2056 has a lateral width that is slightly less than the length of the opening 2014 of the target-hook clasp 2010 allowing the reduced portion to be inserted within the opening 2014 (upon a proper swing of the practice club). The reduced portion 2056 transitions to the wider bottom portion 2057 such that the bottom portion 2057 fits within a target-mount mechanism. The top portion 2055 has an upper top portion 2058 and a lower top portion 2059. The lower top portion 2059 has a width that is slightly less than the length of the slot 2012 of the target-hook clasp 2010. The height of the lower top portion 2059 is slightly greater than the vertical height of the target-hook clasp 2010. The upper top portion 2058 has a lateral width that is greater than the length of the slot 2012 within the target-hook clasp 2010. The lateral width transition between the upper top portion 2058 and the lower top portion 2059 of the top portion 2055 provides a left and right bottom edges 2061 and 2062, respectively.

In operation, (if the club 2001 is swung in a proper predetermined manner) the opening 2014 of the target-clasp 2010 will encircle the reduced portion 2056. The further outward movement of the club 2001 swing causes the reduced portion 2056 to enter the slot 2012 and for the lower top portion 2059 to be captured with in the opening 2012 and for the bottom edges 2061, 2062 to rest on the top of the top edge 2038 of the target-hook clasp. In another embodiment the connection member can be connected with the club 2001 and the ring member can be connected on a mount to provide a target.

Figure 37:
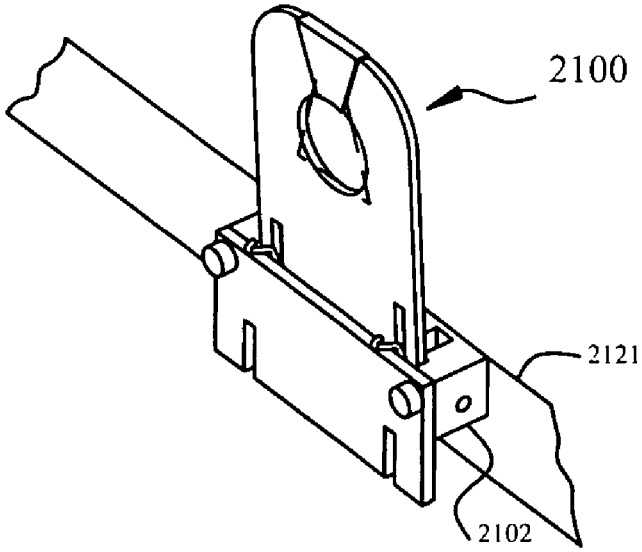
FIGS. 37 and 38 are perspective and exploded views of yet another alternate preferred embodiment mount of the present invention.
Figure 38:
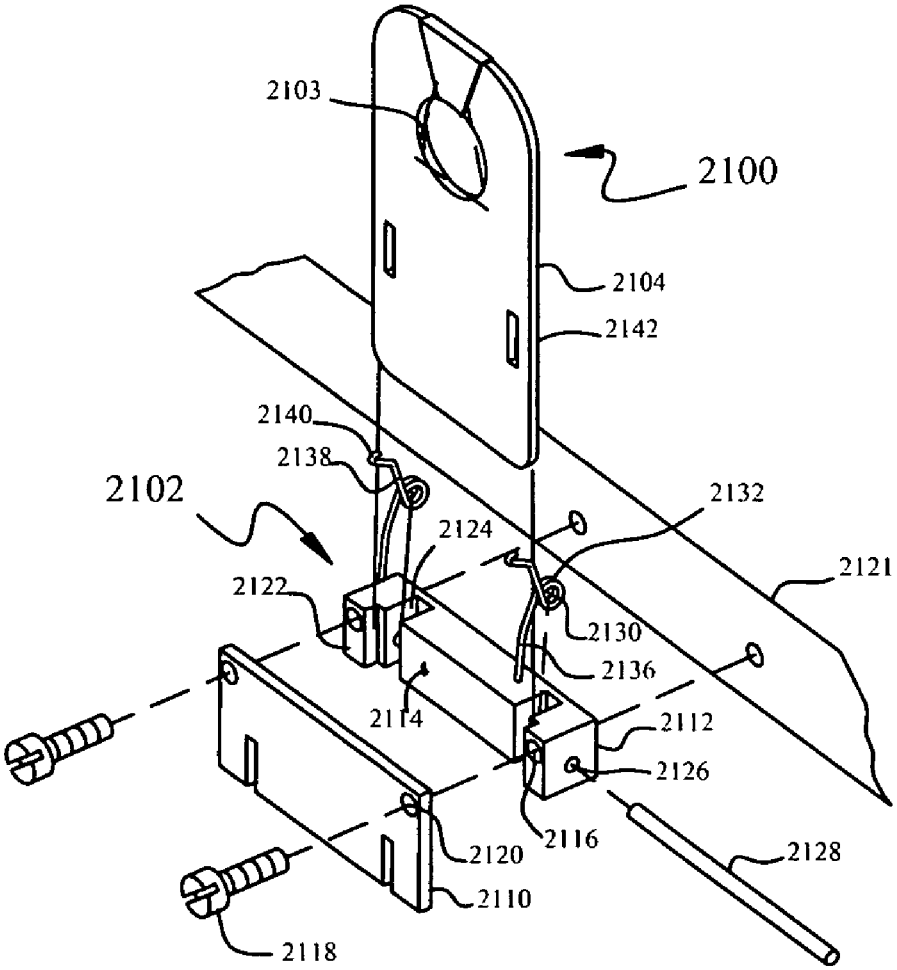

Referring to FIGS. 37-38, an embodiment 2100 of the present invention as shown having a mount 2102 having latched retention with a target 2104. The characteristic material, size, and shape of the target are similar or identical to those described for targets 150, 190, or 1265. However, the target 2104 has holding apertures 2106 for receipt of spring elbows 1240.

The target 2104 has two lower holding apertures 2106. The mount 2108 includes a front plate 2110 and a rear plate 2112. Setscrews 2118 pass through the bores 2120 and 2116 of the front, rear plates, and connect them with a platform 2121. The rear plate 2112 has a forward abutting face 2122 that abuts against the front plate 2110. The rear plate is also provided with a longitudinal slot 2114. The slot 2114 provides a gap between the portion of the rear plate 2112 and front plate 2110 for receipt of the target 2104. The rear plate 2112 also has two parallel spaced generally transverse spring slots 2124. Intersecting the spring slots 2124 is a hole or bore 2126. The bore 2126 receives a pin 2128. The pin 2128 passes through openings 2130 of springs 2132 to mount the springs 2132 within the spring slots 2124. Springs 2132 are coil springs. The springs 2132 have a lower legs 2136 and upper legs 2138. Both upper legs 2138 have an elbow 2140.

A bottom end on target 2104 is brought under the elbows 2140 of the springs 2132. The target is pivoted to a more vertically upward aligned position causing the elbows 2140 of the springs to ride up on a rear surface 2142 of the target. As the target is further pushed down into slot the 2114 the elbows 2140 will finally come to a point wherein they will enter into the holding apertures 2106 of the target. The target 2104 now has snap-fit engagement with the springs 2132 to provide for latched retention. The target 2104 will have further engagement with the springs 2132 by virtue of engagement with the lower legs 2136. The engagement of the target with the lower legs 2136 causes the springs 110, 112 to be torsionally loaded about their coiled portion. Therefore, the target 2104 is also compliantly retained. The target 2104 is now connected with the mount.

When a practitioner swings the golf club in a proper predetermined manner, the latch member (not shown) will enter into the target aperture 2103 to pull the target 2104 upward causing the spring elbows 120 to be pulled out of the retention apertures 2106, to thereby release the target 2104 from the mount.

Figure 39:
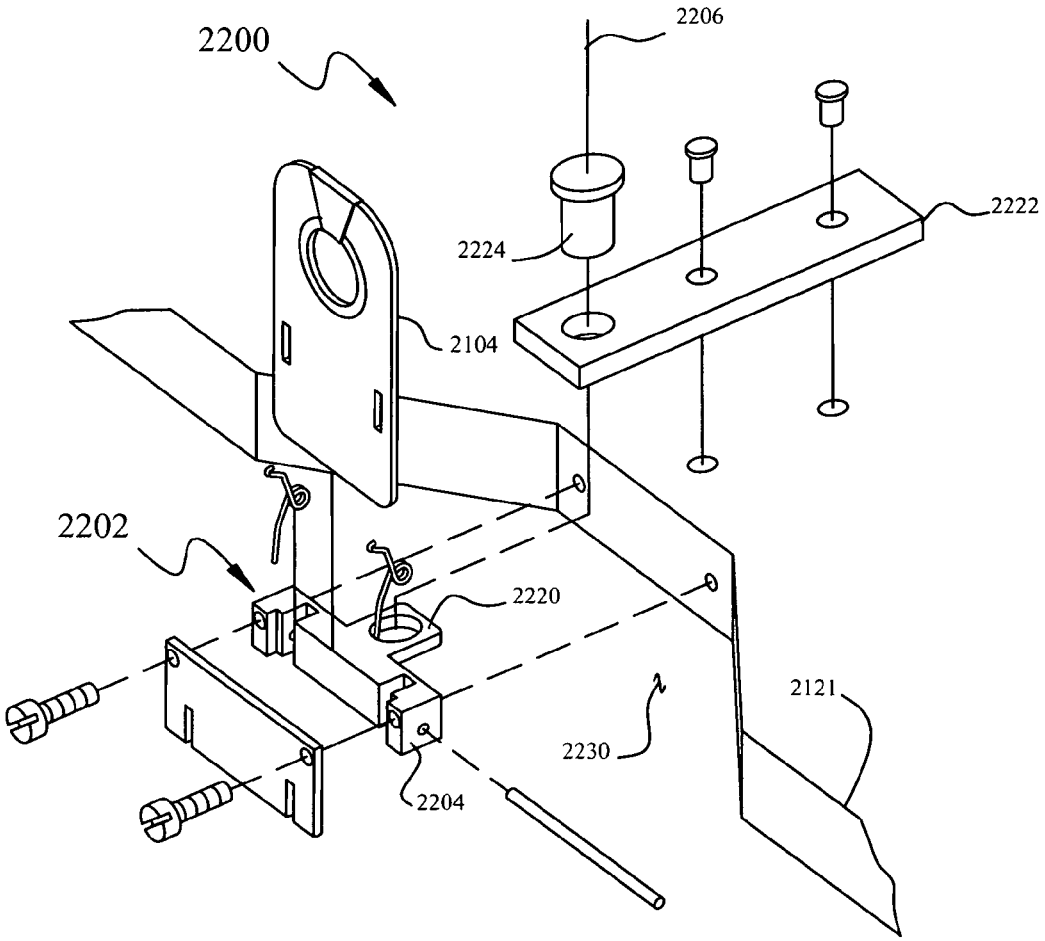
FIG. 39 is an exploded view of yet another alternate preferred embodiment mount of the present invention.

FIG. 39 illustrates an embodiment 2200 of the present invention wherein a mount 2202 has a pivot body 2204. The pivot body 2204 (formed by the front and rear plates) has a predetermined vertical pivot axis 2206 with a base portion provided by the platform 2121. The pivot body has a bored flange 2220. Flange 2220 is pivotally mounted to a cantilever support bean 2222 by a pivot pin 2224. A vertical pivot axis 2206 extends into a bay 2230 of the platform 2121. The pivot axis 2206 is fixed with respect to the platform 2121 and is offset rearward from the target 2104.

Figure 40:
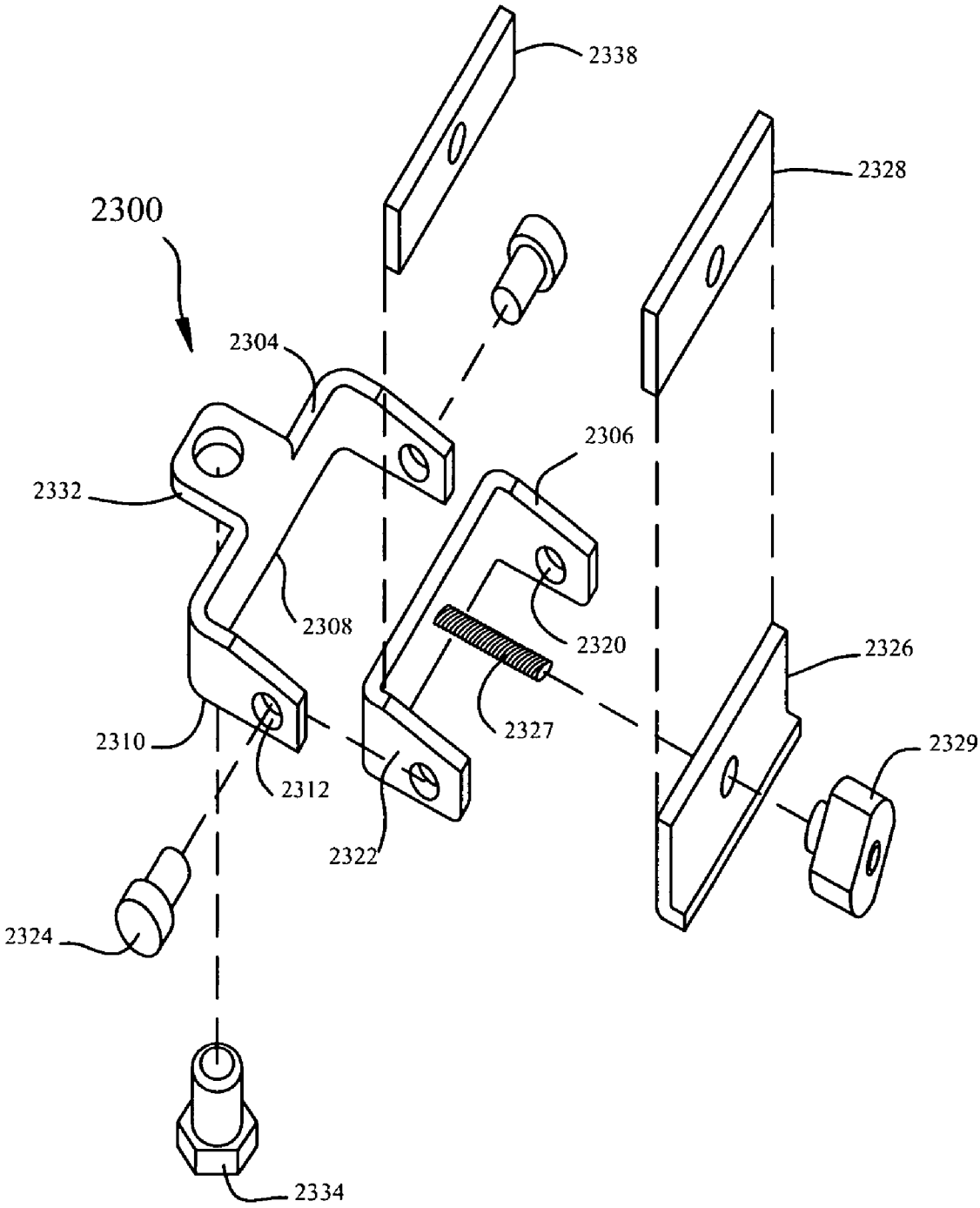
FIG. 40 is an exploded view of yet another alternate preferred embodiment mount of the present invention.
Figure 41:
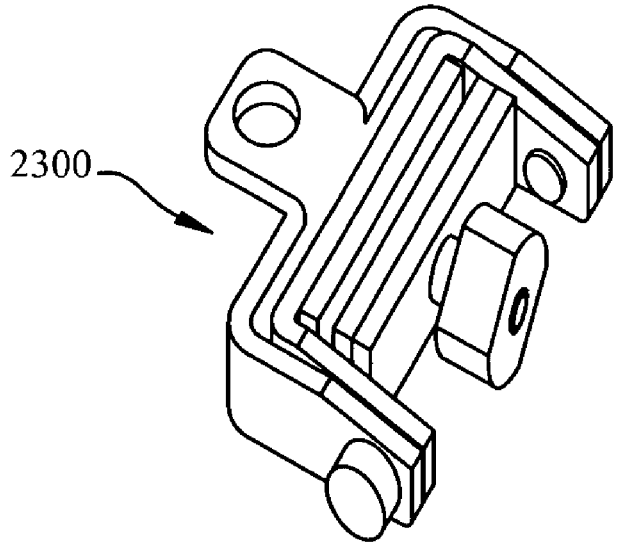
FIGS. 41 and 42 are perspective views the mount shown in FIG. 40.
Figure 42:
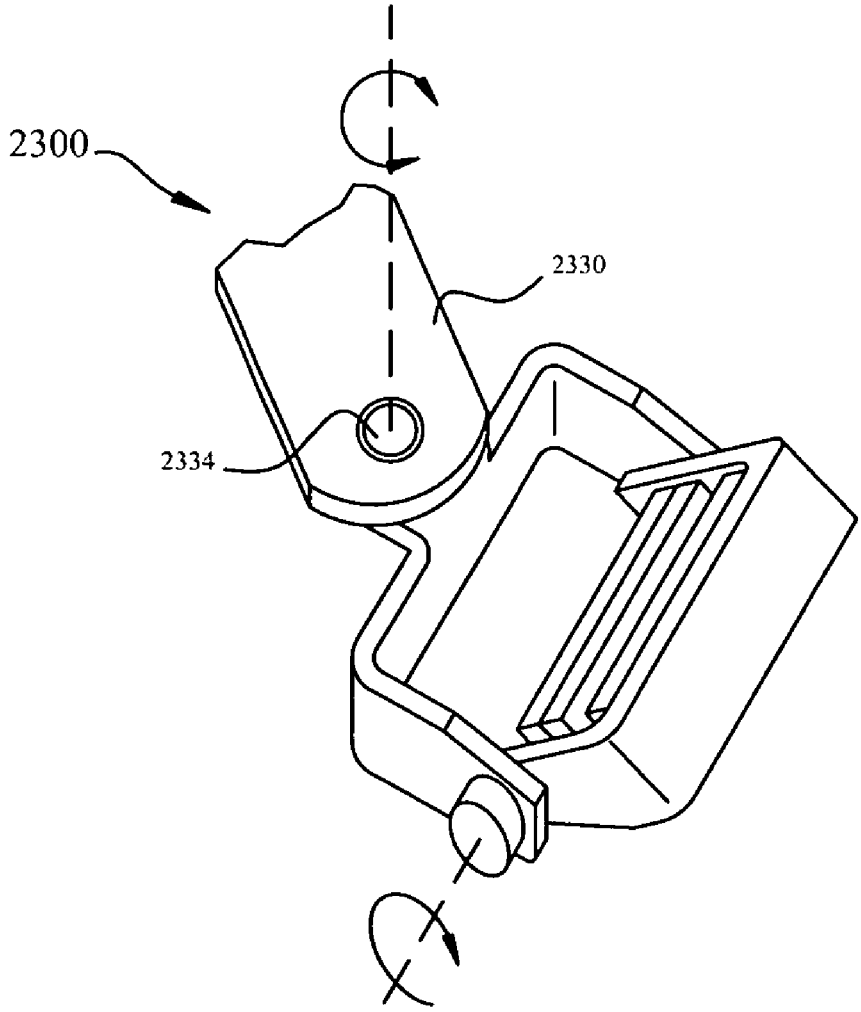
Figure 43:
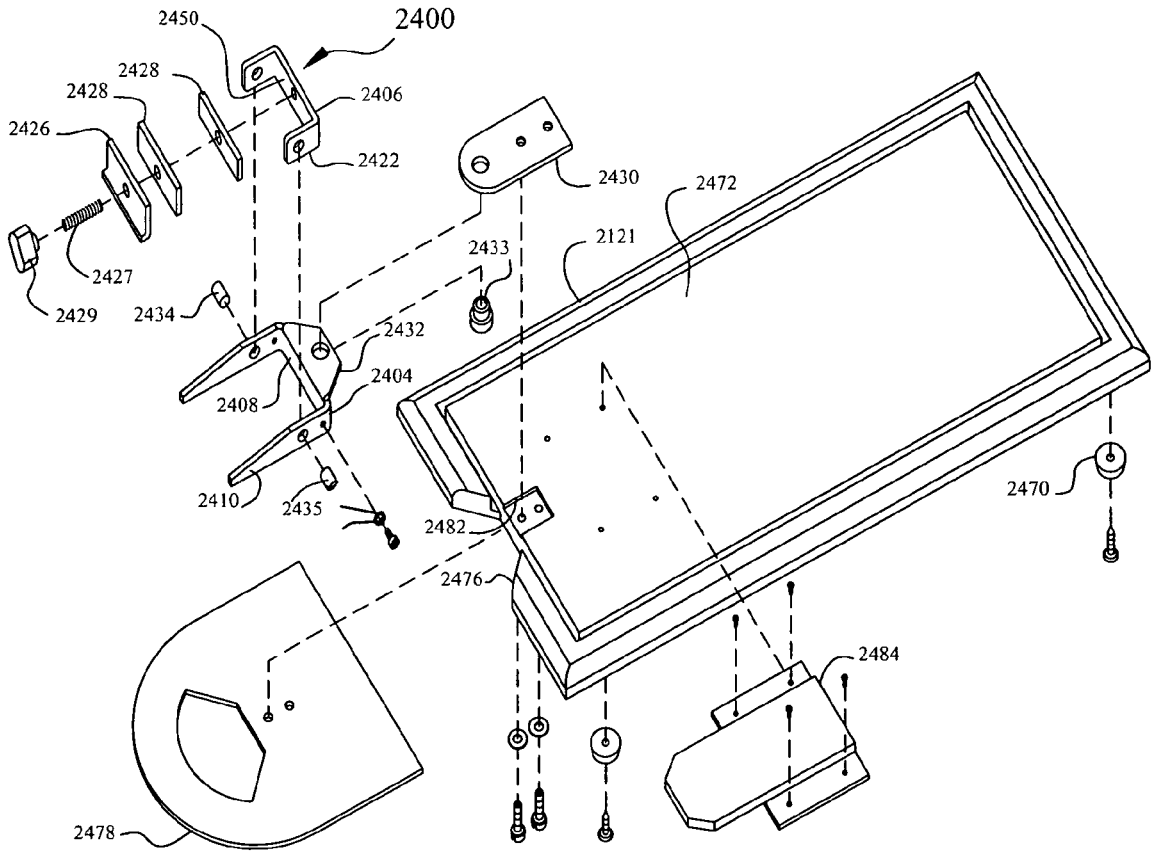
FIG. 43 is an exploded view of yet another alternate preferred embodiment mount of the present invention.
Figure 44:
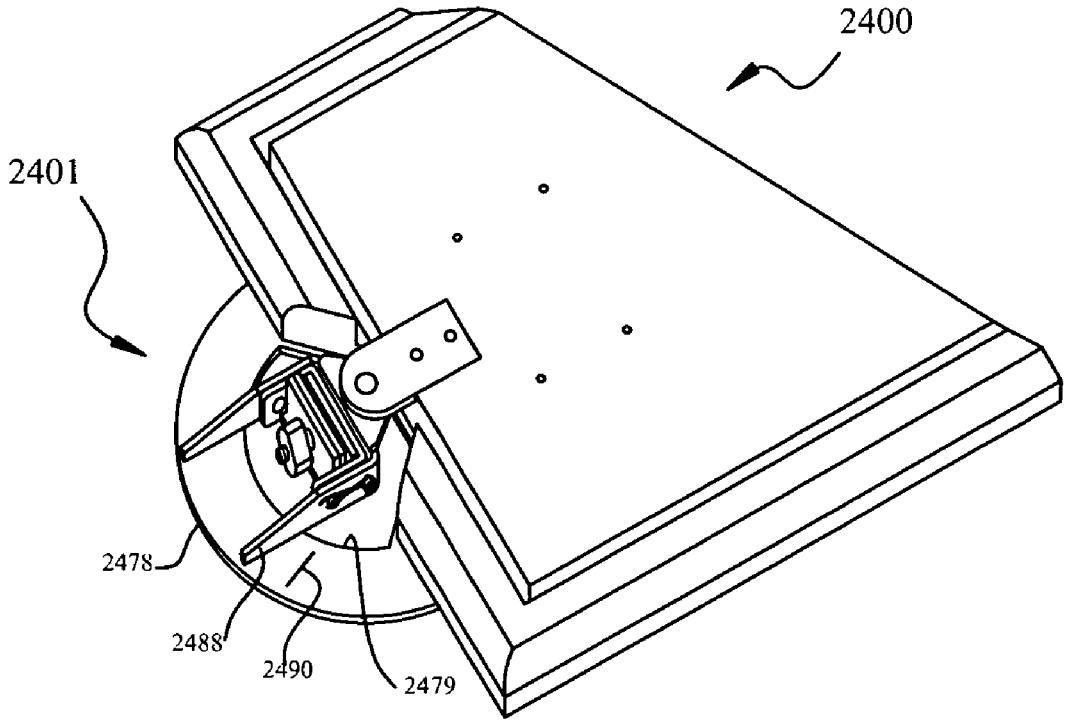
FIGS. 44 and 45 are a perspective and an enlarged partial perspective views of portions of the mount shown in FIG. 43.
Figure 45:
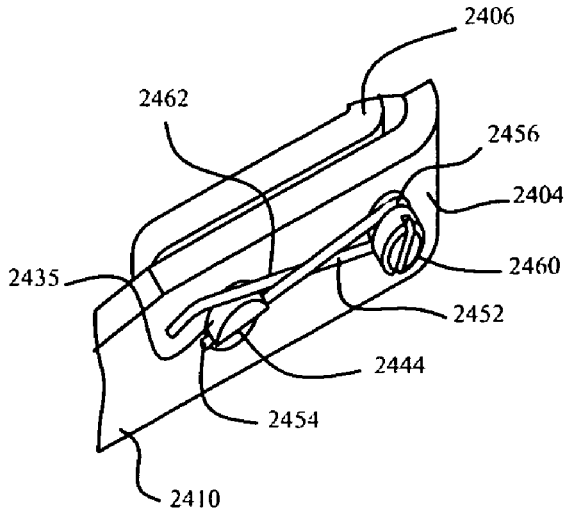

A combination vertically and horizontally pivoting target-holder with clamping mechanism 2300 is provided in FIGS. 40-42. The combination vertically and horizontally pivoting target-holder 2300 includes a pivot body including outer and inner-frame member 2304, 2306. The outer-frame member 2304 rotates independently of the inner-frame member 2306 about a vertical axis. Conversely, the inner-frame member 2306 rotates within the outer-frame member 2304 about a horizontal axis. The frame members in the embodiment of the present invention are preferably formed from a steel material having an optional thickness of ⅛-inch. The outer-frame member 2304 has a rear vertical planar part 2308 that has ninety-degree angular bends at both extreme ends thus forming a left and right sides 2310 that are also planar. The left and right sides 2310 of the outer-frame member 2304 each has a bore 2312 having a ¼-inch diameter. The bore centers are concentric with respect to each other and the bores are coincident with a horizontal longitudinal axis of the outer-frame member 2304. The outer-frame member 2304 has a horizontal planar flange 2314 that projects rearward from an outside face of the outer-frame member 2304. The flange 2314 is centrally located between the left and right sides near a top edge of the outer-frame member 2304. The horizontal part has a ⅜-inch diameter bore having a vertical axis generally perpendicular with a top and bottom face of the horizontal part.

The inner-frame member 2306 is formed such that its outside width dimension provides a loose fit between the inside dimension of the left and right sides 2310 of the outer-frame member 2304. The inner-frame member 2306 also has a ¼-inch diameter bore 2320 in a left and a right side 2322. The side bores of the inner and outer-frame members 2320, 2310 are aligned to receive a pivot pin 2324 when the inner-frame member 2306 is assembled within the outer-frame member 2304. A rear planar part of the inner-frame member 2306 has a ¼-inch diameter bore that is located midway between the sides and near a top edge of the inner-frame member 2306. The rear bore of the inner-frame member 2306 is threaded with ¼×20-pitch threads. A planar clamp plate 2326 is provided having a width dimension that is sufficient to fit within the inside dimension of the opposing sides 2322 of the inner-frame member 2306. The clamp plate has a centrally located bore having a diameter slightly greater than a ¼ of an inch to loosely receive a screw fastener post 2327. A ¼×20-pitch thread wing-nut fastener 2329 is provided to apply a clamping force to a rear face of the clamp plate.

Friction pads 2328 having a thickness range of 1/16-¼ of an inch are adhered to a rear face of the clamp plate and an inside face of the rear vertical part of the inner-frame member 2306. The rear face of the clamp plate 2326 and the inside face of the rear part of the inner-frame member 2306 are opposing when the clamp plate 2326 is received by the fastener post 2327 perpendicularly projecting from the inside rear face. A cantilevered support beam 2330 (FIG. 40) is provided having a pivot bore and a pair of ¼×20-pitch threaded bores (not shown). The beam 2330 is typically connected with a platform (not shown). The pivot bore of the pivot arm has a ⅜-inch diameter that when aligned with the pivot bore in flange 2332 of the outer-frame member 2304 the bores receive a pivot pin 2334.

Referring to FIGS. 40-48 an alternative embodiment 2400 of the present invention is provided having a mount 2401. The mount 2401 includes an outer-frame member 2404 having a flange 2432, a rear planar part 2408, and two forward extending sides 2410 with bores 2412. The outer-frame member 2404 pivotally mounts for 360° movement an inner-frame member 2406. The inner frame-member 2406 is similar to the inner frame number 2306 previously described and in a similar manner has a fastener post 2427, clamp plate 2426, friction pads 2428, sides 2422 with bores 2420. A pivot pin 2434 supports the inner frame number 2406 on one side. On the opposite side the inner frame number 2406 is supported by a pivot pin 2435. The pivot pin 2435 is torsionally fixed with the inner frame-member 2406.

The pivot pin 2435 has a circular profile with an indent 2444 (facing downward in FIG. 45) at its extreme end that is planar. The indent 2444 is both parallel and perpendicular with a longitudinal axis of the pivot pin 2435.

The inner-frame member 2406 supports a practice target (not shown) generally parallel to a front inside face 2450. The inside face 2450 preferably leans forward at a predetermined angle ranging from 1-9 degrees. A torsion spring 2452 has a leg 2454 capturing the indent 2444 at the extreme end and positions the inner-frame member 2404 at the predetermined angle thereby preventing the inner-frame member 2406 from rotating within the outer-frame member 2404 in the absent of an impact force applied against a practice target mounted within the inner-frame member 2404.

An inner diameter of the torsion-spring coil 2456 receives a threaded fastener 2460 that is received by a threaded bore of the outer-frame member 2404. The torsion spring 2452 has legs 2454 and 2462 both of which pivot about the axis of the threaded fastener 2460 when acted thereon by a force applied thereto by a rotation of the indent 2444. The crisscross configuration of the legs 2454, 2462 of the torsion spring provides a preload of opposing torsional forces to the extreme outboard end of the pivot pin 2435. This preload forces the leg 2454 of the torsion spring to be coplanar against the indent 2444 of the pivot pin thereby holding the inner-frame member 2406 at the predetermined angle.

A swing platform 2121 is provided having legs 2470, a front bay 2476, and a top surface 2472. Pivotally supporting the outer-frame 2406 via a pivot pin 2433 is a cantilever support beam 2430. Provided in a cut out in surface 2472 is a scuff pad 2484 preferably provided by elastomeric material. The scuff pad 2484 protects a club from damage from hitting the beam 2430. Connected to the platform 2121 is an indicator dial 2478. The indicator dial 2478 has a cut out 2479 to provide room for a rotating inner-frame member 2406. The outer-frame member 2404 has pointer tips 2488.

Figure 46:
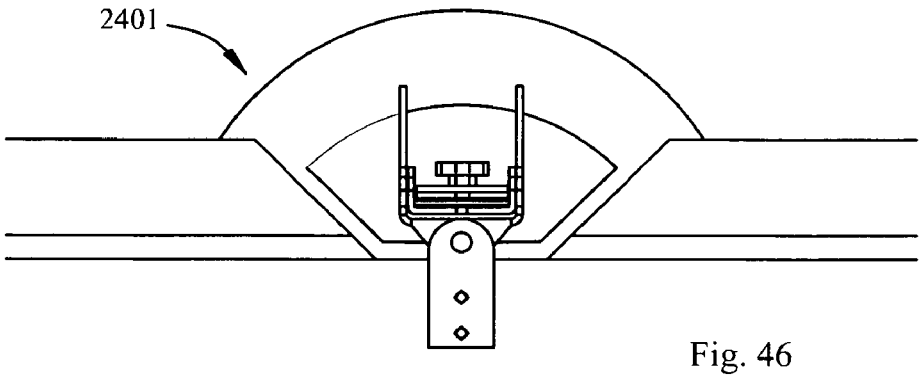
FIGS. 46-48 are partial top plan views illustrating positions of the mount shown in FIGS. 43-45.
Figure 47:
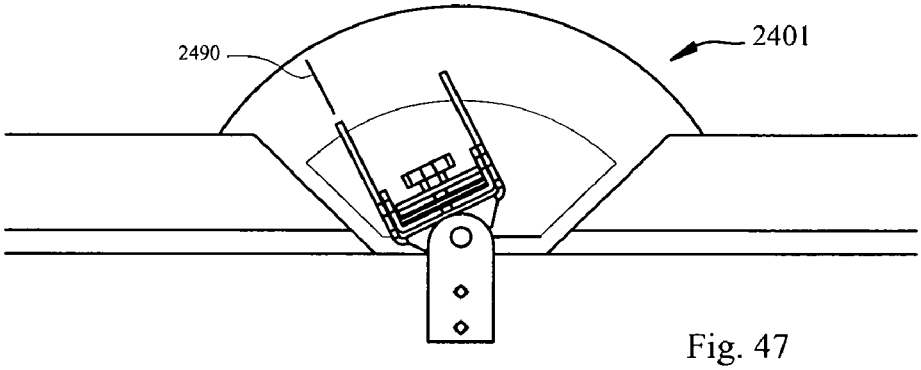
Figure 48:
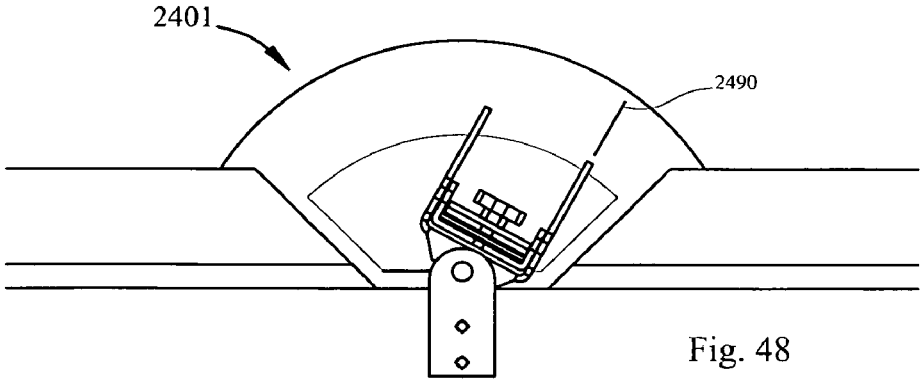

In operation, a target (not shown) is held by the inner-frame member 2406. The target top end will be approximately 1-9 degrees forward with respect to its bottom held end. The outer-frame member 2404 is positioned so that the indicator tips 2488 align with the indicator markings as shown in FIG. 46. If the golf practitioner hits the target with the club in an improper manner, the target will simultaneously pivot about pivot 2433 and the pivot ends 2434 and 2435. A swing at a first level expertise will cause the target to be removed from the inner-frame member 2406 and will cause the outer-frame member 2404 to pivot. The amount of angular rotation about pivot 2433 will be indicated by a reading of the indicator tips 2488 relative to the markings 2490 of the indicator dial 2478. The indicator dial 2478 allows the practitioner to realize the angle of the club face at the point of impact with the target. The amount of pivot of the indicator dial 2478, indicates to the practitioner if the club face was square (FIG. 46), open (FIG. 47 for a right hand user) or closed (FIG. 48 for a right hand user) during the swing. At a more expert level of expertise, the target will be joined to the club and the outer member will still be centered as shown in FIG. 46.

The present invention has been shown in various embodiments. However, it will be apparent to those skilled in the art of the various modifications that can be made to the present invention without departing from the spirit or scope of the invention as it is encompassed by the following claims.

I claim:

1. An apparatus to simulate a proper hitting of a golf ball by a golf club, said apparatus comprising:

a golf club having a shaft with a latch member generally adjacent an extreme end thereof; and a target having an aperture for receipt of said latch member, said target being held in a position to be struck by said golf club on a mount wherein said latch member and said target connect with each other when said golf club is swung in a predetermined manner and wherein said target is retained by said mount if said golf club is not swung in said predetermined manner.

2. An apparatus as described in claim 1 wherein said club further includes a head connected with said shaft adjacent an extreme end, said latch member being connected adjacent said head.

3. An apparatus as described in claim 2 wherein said head is structured to have fastener connected weights added thereto.

4. An apparatus as described in claim 2 wherein said latch member is provided on a generally L shaped planar link placed adjacent a face of said head, said L-shaped link being connected to said shaft with another link.

5. An apparatus as described in claim 1 wherein said latch member is compliantly mounted with respect to said club shaft.

6. An apparatus as described in claim 1 wherein said latch member is spherical.

7. An apparatus as described in claim 1 wherein said target is a planar member.

8. An apparatus as described in claim 1 wherein said mount provides a vertical pivot axis for said target.

9. An apparatus as described in claim 8 wherein said vertical pivot axis is fixed with respect to said target.

10. An apparatus as described in claim 8 wherein said vertical pivot axis is offset from said target.

11. An apparatus as described in claim 8 wherein said mount provides a horizontal pivot axis for said target.

12. An apparatus as described in claim 11 wherein said horizontal pivot axis is offset from said target.

13. An apparatus as described in claim 1 wherein said target may have different aperture sizes to determine various levels of expertise required in the manner of swing of said golf club for said latch member to connect with said target.

14. An apparatus as described in claim 1 wherein said target aperture opens to an upper aperture along an upper edge of said aperture.

15. An apparatus as described in claim 1 further including an optional dummy target held by said mount adjacent to said target, said dummy target being pivotal with said mount and pivoting downward and retained by said mount when hit by golf club to give an indication of a swing that is off the mark.

16. An apparatus as described in claim 1 further wherein said mount includes a platform, and said platform having an elastomeric scuff pad.

17. An apparatus to simulate a proper hitting of a golf ball by a golf club, said apparatus comprising:

a golf club having a shaft with a latch member generally adjacent an extreme end thereof; and a target having an aperture for receipt of said latch member, said target being held in a position to be struck by said golf club on a mount, said mount providing a fixed vertical pivot axis offset from said target and a horizontal pivot axis for said target, and wherein said latch member and said target connect with each other when said golf club is swung in a predetermined manner and wherein said target is retained by said mount if said golf club is not swung in said predetermined manner.

18. An apparatus to simulate a proper hitting of a golf ball by a golf club, said apparatus comprising:

a golf club with a latch member adjacent an extreme end thereof;

a target for connection with said latch member; and a mount holding said target, said mount having front and rear surfaces providing an interface therebetween, said target being frictionally retained between said surfaces, wherein when said golf club is swung in a predetermined manner, said target is connected with said latch member and wherein when said golf club is swung in a non predetermined manner, said target is retained by said mount.

19. An apparatus as described in claim 18 wherein at least one of said surfaces can move with respect to said other surface.

20. An apparatus as described in claim 18 wherein one of said surfaces is actuated by a cam.

21. An apparatus as described in claim 18 wherein said cam actuation is adjustable.

22. An apparatus as described in claim 18 wherein said surfaces are polymeric.

23. An apparatus as described in claim 18 wherein said target is fabricated from a high molecular weight polyethylene material.

24. An apparatus as described in claim 18 wherein said target has a thickness generally between 0.085-0.135 inch.

25. An apparatus as described in claim 24 wherein said target is fabricated from a high molecular weight polyethylene material.

26. An apparatus as described in claim 18 wherein said mount provides a vertical pivot axis for said target.

27. An apparatus as described in claim 26 wherein said mount provides a horizontal pivot axis for said target.

28. An apparatus to simulate a proper hitting of a golf ball by a golf club, said apparatus comprising:

a golf club with a latch member adjacent an extreme end thereof;

a target for connection with said latch member; and a mount holding said target, said mount having latched retention with said target wherein when said golf club is swung in a predetermined manner, said target is connected with said latch member and wherein when said golf club is swung in a non predetermined manner, said target is retained by said mount.

29. An apparatus as described in claim 28 wherein said mount provides a vertical pivot axis for said target.

30. An apparatus to simulate a proper hitting of a golf ball by a golf club, said apparatus comprising:

a golf club with a latch member adjacent an extreme end thereof;

a target for connection with said latch member;

a mount holding said target, wherein when said golf club is swung in a predetermined manner, said target is connected with said latch member and wherein when said golf club is swung in a non predetermined manner, said target is retained by said mount; and a ring member having a predefined opening and a connection member, said connection member having extreme enlarged ends juxtaposed by a reduced portion insertable within said predefined opening, one of said ring and connection members providing said latch member and said other ring member and connection member providing said target.

* * * * *